US007044421B1

(12) United States Patent
Omdoll et al.

(10) Patent No.: US 7,044,421 B1
(45) Date of Patent: May 16, 2006

(54) ELECTRONICALLY CONTROLLED ROLL TOWEL DISPENSER WITH DATA COMMUNICATION SYSTEM

(75) Inventors: Paul A. Omdoll, Waukesha, WI (US); Steven D. Hoyt, Lake Geneva, WI (US); Scott Collins, Milwaukee, WI (US); Brian Hubanks, Dousman, WI (US)

(73) Assignee: The Colman Group, Inc., Elkhorn, WI (US)

( * ) Notice: Subject to any disclaimer, the term of this patent is extended or adjusted under 35 U.S.C. 154(b) by 0 days.

(21) Appl. No.: 09/959,251

(22) PCT Filed: Apr. 20, 2000

(86) PCT No.: PCT/US00/10761

§ 371 (c)(1),
(2), (4) Date: Jan. 29, 2002

(87) PCT Pub. No.: WO00/63100

PCT Pub. Date: Oct. 26, 2000

Related U.S. Application Data

(60) Provisional application No. 60/130,137, filed on Apr. 20, 1999, and provisional application No. 60/159,006, filed on Oct. 11, 1999.

(51) Int. Cl.
*B65H 16/10* (2006.01)

(52) U.S. Cl. ..... 242/564.4; 242/563; 242/564.1

(58) Field of Classification Search ..... 242/563, 242/564.1, 564.4
See application file for complete search history.

(56) References Cited

U.S. PATENT DOCUMENTS

| | | | |
|---|---|---|---|
| 3,730,409 | A | 5/1973 | Ratti |
| 4,119,255 | A | 10/1978 | D'Angelo |
| 4,270,818 | A | 6/1981 | McCabe |
| 4,666,099 | A | 5/1987 | Hoffman et al. |
| 4,738,176 | A | 4/1988 | Cassia |
| 4,765,555 | A | 8/1988 | Gambino |
| 4,790,490 | A | 12/1988 | Chakravorty |
| 4,796,825 | A | 1/1989 | Hawkins |
| 4,817,483 | A | 4/1989 | Armbruster |
| 4,848,854 | A | 7/1989 | Kennedy |
| 4,960,248 | A | 10/1990 | Bauer et al. |
| 5,001,953 | A | 3/1991 | Pfeiffer |
| 5,031,258 | A | 7/1991 | Shaw |

(Continued)

FOREIGN PATENT DOCUMENTS

| | | |
|---|---|---|
| EP | 0 573 558 B1 | 12/1997 |
| WO | WO 99/59457 | 11/1999 |

*Primary Examiner*—John Q. Nguyen
(74) *Attorney, Agent, or Firm*—Adam L. Brookman; Piliero Goldstein Kogan Miller

(57) ABSTRACT

An electronically controlled roll towel dispenser with a data communication system. The dispenser automatically dispenses a predetermined length of paper toweling from a supply roll after a length of toweling has been detached by a user pulling and tearing the protruding toweling against a stationary cutting blade. The dispenser is battery powered with an electric motor, an electromechanical dispensing mechanism, and an embedded microcontroller for controlling and monitoring operation of the dispenser. In addition to primary control functions, the microcontroller monitors parameters such as battery condition, towel usage, system status, system errors, and unsafe operating conditions. Push-button switches are also provided for programming towel length and the dispense delay. The dispenser further includes an optical transmitter for transmitting visual and infrared data to a receiving device. Useful information about the status of the dispenser can be visibly discerned by an operator through the use of primitive low-speed flash patterns, while high-speed infrared digital data can be simultaneously embedded in or multiplexed with the visible data.

32 Claims, 21 Drawing Sheets

U.S. PATENT DOCUMENTS 5,075,792 A 12/1991 Brown et al.
5,107,734 A 4/1992 Armbruster
5,294,192 A 3/1994 Omdoll et al.
5,452,832 A 9/1995 Niada
5,625,908 A 5/1997 Shaw
5,691,699 A 11/1997 Vane et al.
5,691,919 A 11/1997 Gemmell et al.
5,772,291 A 6/1998 Byrd et al.
6,069,354 A 5/2000 Alfano et al.
6,213,424 B1 * 4/2001 Helfer-Grand ..... 242/564.1
6,360,181 B1 * 3/2002 Gemmell et al. ..... 702/128

* cited by examiner

ELECTRONICALLY CONTROLLED ROLL TOWEL DISPENSER WITH DATA COMMUNICATION SYSTEM

CROSS-REFERENCE TO RELATED APPLICATIONS

This application claims the benefit of U.S. Provisional Application Ser. No. 60/130,137, filed Apr. 20, 1999 and U.S. Provisional Application Ser. No. 60/159,006, filed Oct. 11, 1999.

BACKGROUND OF THE INVENTION

The present invention relates generally to paper towel dispensers, and more particularly to an automatic electronically controlled roll towel dispenser with a data communication system for collecting data from the dispenser and transmitting the data to a receiving device for analysis.

Dispensers for dispensing paper towels are well known in the art. A paper towel dispenser typically requires a user actuate a mechanism for the dispenser to dispense paper toweling. Folded paper towels are pre-cut and folded into various configurations to be individually dispensed. Roll paper towels are continuous rolls of paper which are wound around a central core and dispensed by advancing a length of paper toweling from the dispenser and tearing off the length of toweling along a stationary cutting bar in the dispenser.

Folded towels are paper towels which are pre-cut and folded into various configurations. The use of folded paper towel dispensers allows a user to dispense towels by pulling on the exposed end of each new individual towel. These dispensers are also very easy to refill with folded towels. However, a number of the folded towels will often fall out when an exposed towel is pulled. This can result in a significant waste of paper towels. Accordingly, folded towel dispensers are not as economical as other types of alternative dispensers.

Roll towels are less expensive to manufacture and produce less waste than folded towels. A roll towel dispenser typically includes a housing, a supply of paper in the housing, and a mechanism for unrolling a length of paper for use. Roll towel dispensers may include a lever, crank, or other mechanism for dispensing a length of towel from the dispenser chassis and a serrated blade for cutting the length of towel from the remaining roll. However, manual contact with a dispensing lever or the like raises health concerns for the user. To alleviate these health concerns, dispensers have been developed, such as disclosed in U.S. Pat. No. 4,712,461 to Rasmussen, that eliminate contact with any part of the dispenser, and instead rely upon the user directly pulling the paper towel from the dispenser. In these type dispensers, the paper toweling must have sufficient tensile strength to effect rotation of the feed roller and actuation with the cutting blade without premature tearing. Paper possessing the requisite tensile strength to operate these dispensers is limited in the amount of softness and absorbency it can provide.

Another disadvantage of manual roll towel dispensers is that the user generally controls the length of paper dispensed prior to tearing it off the dispenser. A user can therefore wastefully dispense an excessive length of toweling. This adds to the waste and abuse associated with known paper towel dispensers.

Electrically powered roll towel dispensers are also known in the prior art. Such an example is disclosed in U.S. Pat. No. 5,452,832 to Niada. In this patent, a light sensitive device is used to detect the presence of a user's hand in front of the dispenser. After detecting the user's hand, the dispenser advances paper toweling for a predetermined length of time. The dispensed length of paper towel is then separated from the supply roll by pulling the paper toweling against a serrated cutting bar on the dispenser.

U.S. Pat. No. 4,738,176 to Cassia discloses an electrically powered dispenser which includes a reciprocating cutter to produce an individual towel from the continuous web of paper. While this arrangement enables the use of softer and more absorbent paper, the dispenser requires a substantial amount of energy to drive both the feed mechanism and the reciprocating cutter. Accordingly, the batteries for this dispenser must be replaced frequently. Moreover, the dispenser design is much more complex and costly than other systems.

Also, in some electrically powered dispensers, such as the dispenser disclosed in U.S. Pat. No. 4,796,825 to Hawkins, the paper will continuously dispense while a user's hand or other object is placed in front of the sensor. Thus, the dispenser is subject to easy abuse and waste of paper. In an effort to avoid abuses, some dispensers, such as U.S. Pat. No. 4,666,099 to Hoffman, have incorporated a waiting period where the dispenser will not operate for a brief time after each use. However, the need to wait can be frustrating to some users.

None of the known prior art dispensers incorporate a microcontroller or an electromechanical triggering mechanism for controlling operation of the roll towel dispenser. In addition, none of the prior art shows or discloses the use of an optical data link for transmitting status and usage data to a receiving device for analysis.

Optical data links are also well known in the art for use in transmitting data between electrical devices. For example, U.S. Pat. No. 5,691,699 to Vane et al. discloses a security detector having an optical data transmitter. Communication with visible light is typically limited to use with fiber-optic data links, while open-air optical data links typically operate in the infrared (IR) range. Well known are the familiar IR-remote control devices used to control home video and audio electronics. Other familiar methods of optical data communication include the Infrared Data Association (IRDA) standard used with personal computers, lap tops, computer peripherals, and personal organizers to provide wireless data transfer between devices.

Therefore, there is a need for an improved electronically controlled roll towel dispenser having an embedded microcontroller for controlling and monitoring the dispenser, and having a transmitter for transmitting data to a receiving device that is of a simpler design and is less expensive than prior art systems.

SUMMARY OF THE INVENTION

It is therefore an object of the present invention to provide a dispensing apparatus which automatically dispenses a predetermined length of paper towel in response to a user tearing off a previously dispensed length of towel.

Another object of the invention to provide an electronically controlled roll towel dispenser that is completely intuitive to use, a user does not have to know or learn anything new, a length of exposed paper towel extends from the dispenser, a user merely tears the exposed length of towel from the dispenser without touching the dispenser, in response to the tearing action and after a short delay, the dispenser is automatically triggered to dispense another length of towel for the next user.

A further object of the invention is to provide a dispensing apparatus which does not require a user to physically contact the apparatus during use.

Still another object of the invention is to provide a dispenser wherein the lengths of paper towel automatically dispensed and the dispense delay after the dispenser is automatically triggered to dispense another length of towel for the next user are programmable.

Yet another object of the invention is to provide a dispenser that includes a microcontroller running an embedded program for monitoring the dispenser for system errors, collecting data from the dispenser, storing the data in memory, and controlling operation of the dispenser; a data transmitter coupled to the microcontroller for transmitting system errors and dispenser data stored in memory; and a data receiver located remotely from the dispenser for receiving data from the data transmitter.

The present invention is directed to an electronically controlled roll towel dispenser with a data communication system. The dispenser includes a data transmitter preferably in the form of a bi-colored LED. The data transmitted by the dispenser can be received visibly through blinking LED data and through IR data packets. The addition of intelligent electronics into the roll towel dispenser creates a dispenser that automatically dispenses a predetermined length of paper toweling from a supply roll, monitors the status of the dispenser, and collects dispenser data to be transmitted to a remotely located data receiver for analysis.

The data receiver is preferably a personal organizer or personal digital assistant (PDA) operating with a Palm OS operating system and an integral infrared (IR) receiver, such as those manufactured by 3Com Corporation. The data transmitter is preferably an IR-emitting bi-colored LED, providing a simple, low cost alternative for data transmission. The physical communication protocol between the data transmitter and the data receiver preferably complies with standard HP-SIR protocol. In the present invention, IR data is transmitted only when the dispenser cover is open while in the service mode.

An exposed length of toweling is removed from the electronically controlled dispenser by the familiar pulling and tearing action. To accomplish this end, the dispenser implements an electromechanical trigger mechanism to translate the physical motion of a towel being tom across a cutting bar and a rotatable trigger arm on the dispenser into an electrical signal. This signal directs a motorized drive mechanism to automatically dispense a fresh portion of towel. The electronic control of the electromechanical dispensing process is provided by an embedded microcontroller.

In addition to controlling the electromechanical dispense processes, the embedded microcontroller provides other useful benefits. It can effect a programmable dispense delay to reduce towel consumption and waste. The length of paper toweling dispensed and its lineal feed rate are also programmable operating parameters. Access to modify any of these parameters is automatically enabled whenever the dispenser cabinet cover is opened for periodic service. The microcontroller also has the ability to monitor and record important dispenser usage quantities and events. For example, the microcontroller can be programmed to automatically record the date and time of paper outage and refill, automatically monitor the usage of toweling to determine times of peek usage or total paper distributed from a particular dispenser, automatically provide a usage history to allow end users to plan maintenance and ordering of supplies, and automatically page or otherwise notify service personnel of machine status. This paging feature may be incorporated into the functionality of the dispenser by the microcontroller triggering the data transmitter to send a paging signal to service personnel in the event of a system error or other service requirements, such as replacing batteries, replenishing the paper supply, clearing paper jams, or other serviceable events The dispenser is fully programmable to dispense any length of paper, at any speed, and with any dispense delay. The dispenser utilizes pushbutton switches on a control panel to select and adjust these parameters. Moreover, the dispenser can also acquire and store dispenser usage information to be transmitted by the data transmitter to a data receiver in the event of system errors, low battery voltage, or low paper supply. The data may also be used to determine paper usage patterns for inventory management or for planning maintenance.

In an alternative operating mode, called a hygienic mode, only a short length of paper toweling is dispensed from the dispenser. In the normal operating mode, typically 10, 12 or 14 inches of paper toweling is dispensed, while in the hygienic mode only 3 or 4 inches of paper toweling is dispensed. The hygienic mode is preferably used to limit the exposure of bacteria and germs present in most washrooms where the dispensers are located on the exposed toweling. In use, when a user pulls on the short length, a full length is automatically presented. After the full length is torn off by the user, another short length is presented for the next user.

The dispenser is designed to dispense any grade of roll towel paper including low basis weight paper. The power driven, microcontroller controlled internal feeding mechanism is designed to dispense any paper easily and smoothly. All the user does is tear off the exposed length of paper and another length is automatically dispensed. The dispenser is preferably powered with four D-size alkaline batteries, but may be powered from another DC power source, such as a DC power supply or an AC to DC transformer. The dispenser is designed so that the batteries last from six to twelve months. The dispenser continuously monitors battery voltage and includes a low battery status indicator provided by the data transmitter.

The present embodiment is that of an improvement to the electronic control system of a battery-powered roll towel dispenser. This dispenser features a data transmitter for transmitting visual and IR data to a remote data receiver. The data may include a variety of system and service conditions to the user or maintenance person. For example, failure modes are typically indicated by red flashing patterns, while the relative battery condition is indicated by green, yellow or red flashes which represent good, marginal or low battery voltage, respectively. The color and pattern of each particular indicator signal is determined by the firmware programmed into the dispenser's embedded microcontroller.

Various other features, objects, and advantages of the invention will be made apparent to those schooled in the art from the following detailed description and accompanying drawings.

DETAILED DESCRIPTION OF THE INVENTION

Figure 1:
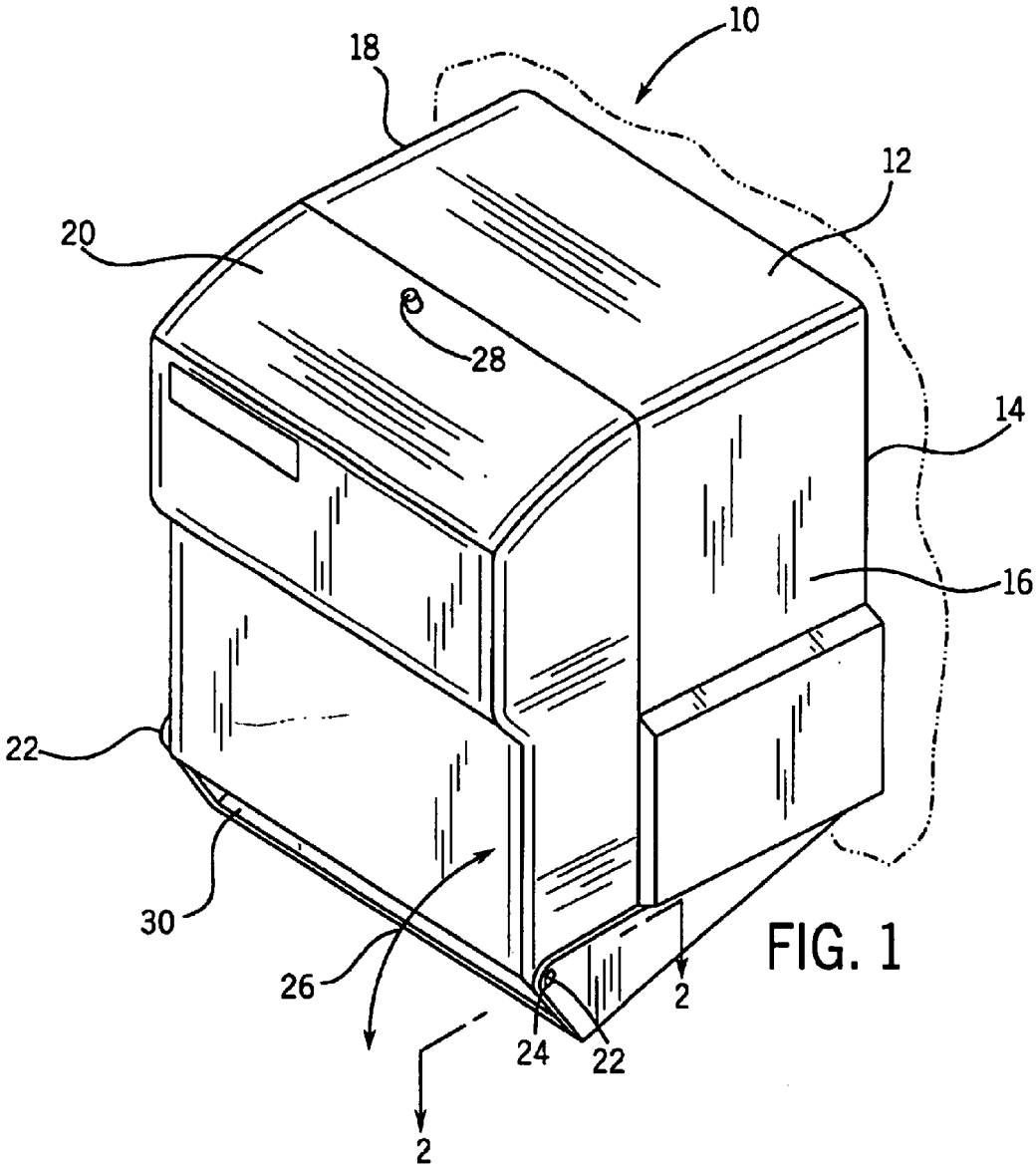
FIG. 1 is a perspective view of an electronically controlled roll towel dispenser constructed in accordance with the present invention.

Referring first to FIG. 1, an electronically controlled paper towel dispenser 10 is shown constructed in accordance with the present invention. The paper towel dispenser 10 includes an outer housing 12 having a back panel 14 adapted to be fastened to a wall, right and left side panels 16 and 18, and a front cover 20. The front cover 20 is pivotally mounted to a lower portion of the housing 12 with hinge pins 22 extending outwardly on each side of the bottom of the cover 20 which are inserted into openings 24 on the bottom front of right and left side panels 16, 18. The front cover 20 is movable between a secured closed position and an open position as illustrated by arrow 26. The cover 20 is securable to an upper portion of the housing 12 by a latch 28 or other fastening device to maintain the front cover 20 in a closed position. The front cover 20 is typically opened for servicing, collecting data, and loading roll paper into the dispenser 10. The roll consists of a continuous web of paper wound upon a hollow cylindrical core (not shown) that is installed in the dispenser. A discharge opening 30 for feeding a length of roll paper out of the dispenser 10 is located at the bottom of the housing 12 below the front cover 20. The housing 12 and front cover 20 are preferably made of plastic or any other type of lightweight material.

Figure 2:
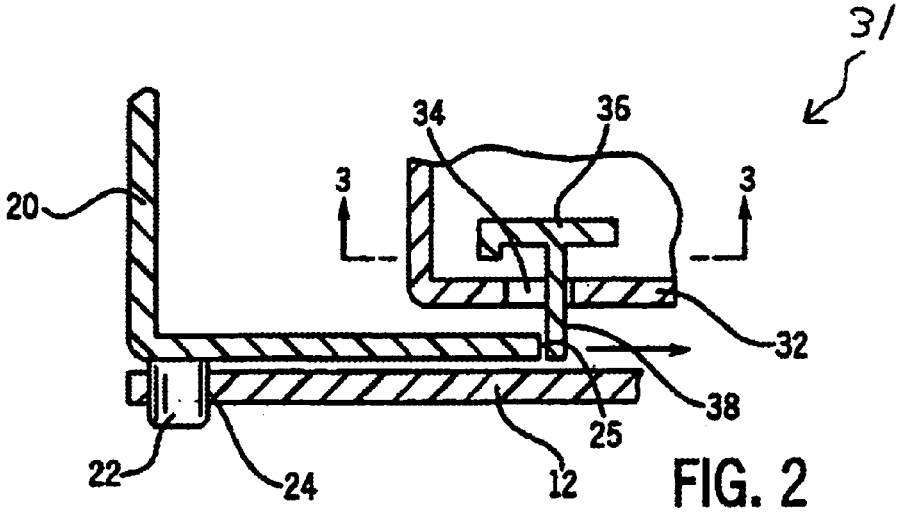
FIG. 2 is a cross-sectional view of a cover interlock assembly taken along line 2—2 of FIG. 1.
Figure 3:
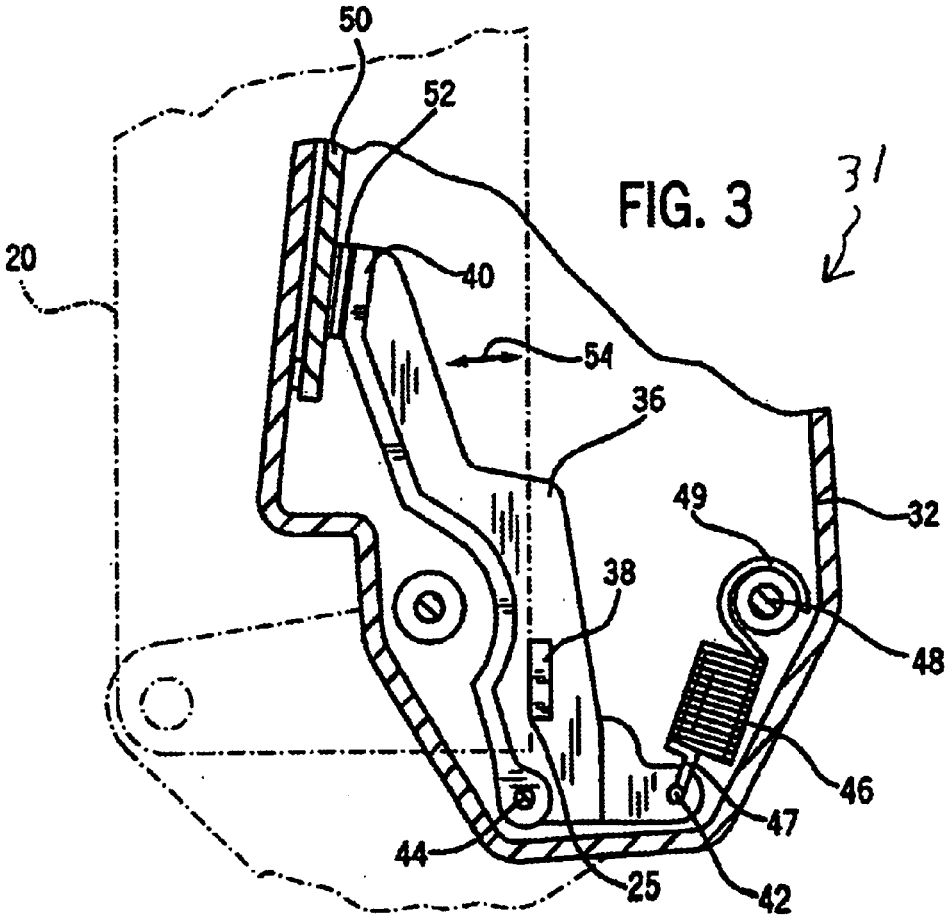
FIG. 3 is a cross-sectional view taken along line 3—3 of FIG. 2.

FIGS. 2 and 3 illustrate a cover interlock assembly 31. The cover interlock assembly 31 is essentially a safety interlock which monitors the position of the front cover 20. The components of the cover interlock assembly 31 are installed in a drive control assembly 32 mounted to the side of the housing 12. The components of the cover interlock assembly 31 include a cover lever 36 pivotally mounted to the drive control assembly 32 at a pivot point 44, the cover lever 36 having a tab 38 extending outwardly therefrom which contacts a bottom edge 25 of the cover 20 when in a closed position. The tab 38 extends through and is movable in a slotted opening 34 extending through the drive control assembly 32. The cover lever 36 further having a first end 40 for contacting a cover switch 52 on a printed circuit board 50 installed in the drive control assembly 32, and a second end 42 opposite the first end 40 connected to a first end 47 of a helical spring 46. The helical spring 46 having a second end 49 connected to a rigid post 48 on the drive control assembly 32. The spring 46 biases movement of the cover lever 36 between the first end 40 depressing the cover switch 52 when the cover is in a closed position and not contacting the cover switch 52 when the cover is in an open position as shown by arrow 54. When the cover 20 moves from an open position to a closed position, the bottom edge 25 of the cover 20 comes in contact with the tab 38 to move the cover lever 36 in position to close the switch 52.

Contacting the normally open switch 52 with the closed cover 20 provides an electrical signal to a microcontroller U2 on the printed circuit board 50 representing that the dispenser 10 is in a normal operating mode. When the cover 20 is open and the first end 40 of the cover lever 36 is not contacting the switch 52, the dispenser 10 is in a non-operating service mode as described in more detail below.

Figure 4:
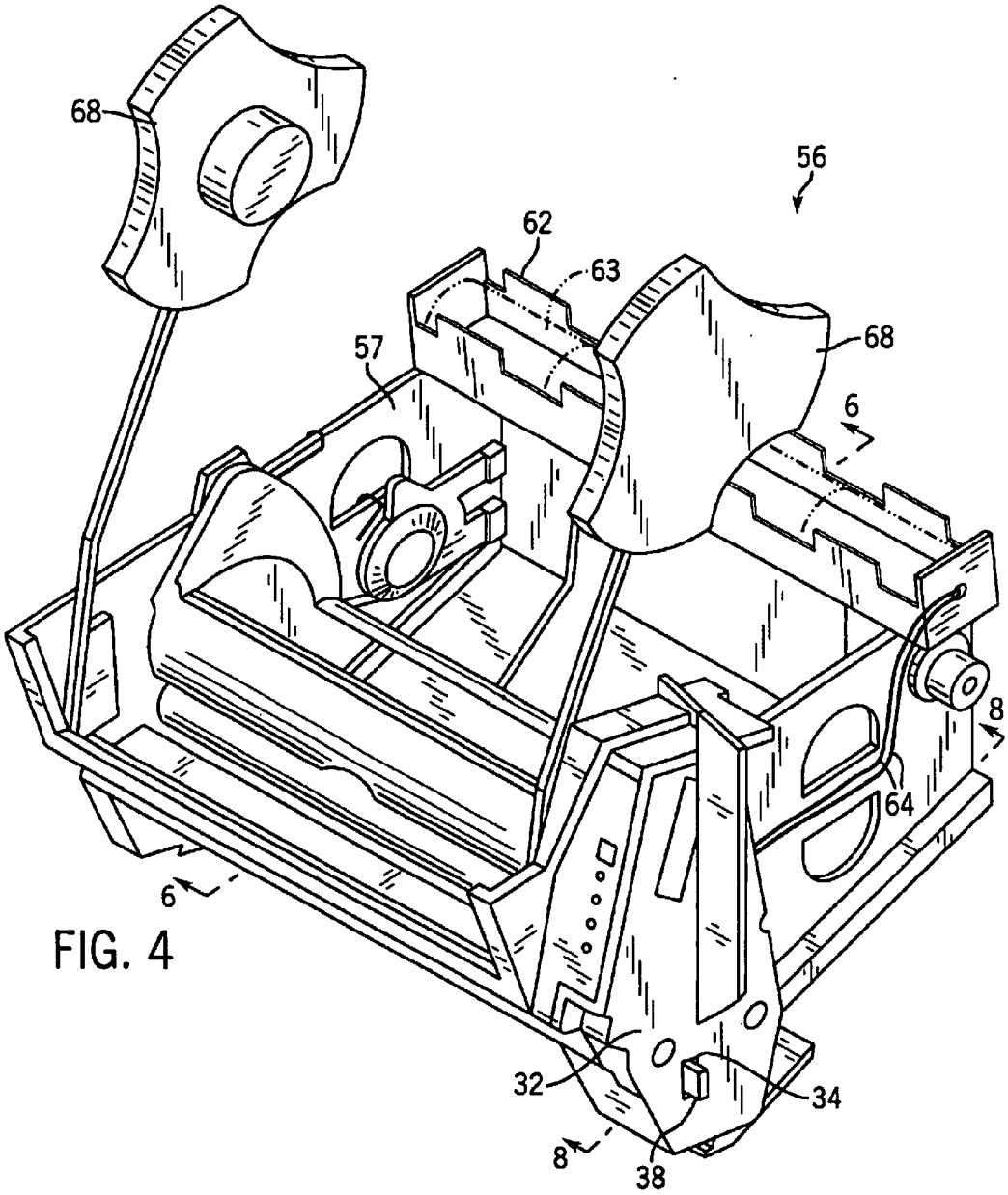
FIG. 4 is a perspective view of a dispenser assembly that is installed in the roll towel dispenser of FIG. 1.
Figure 6:
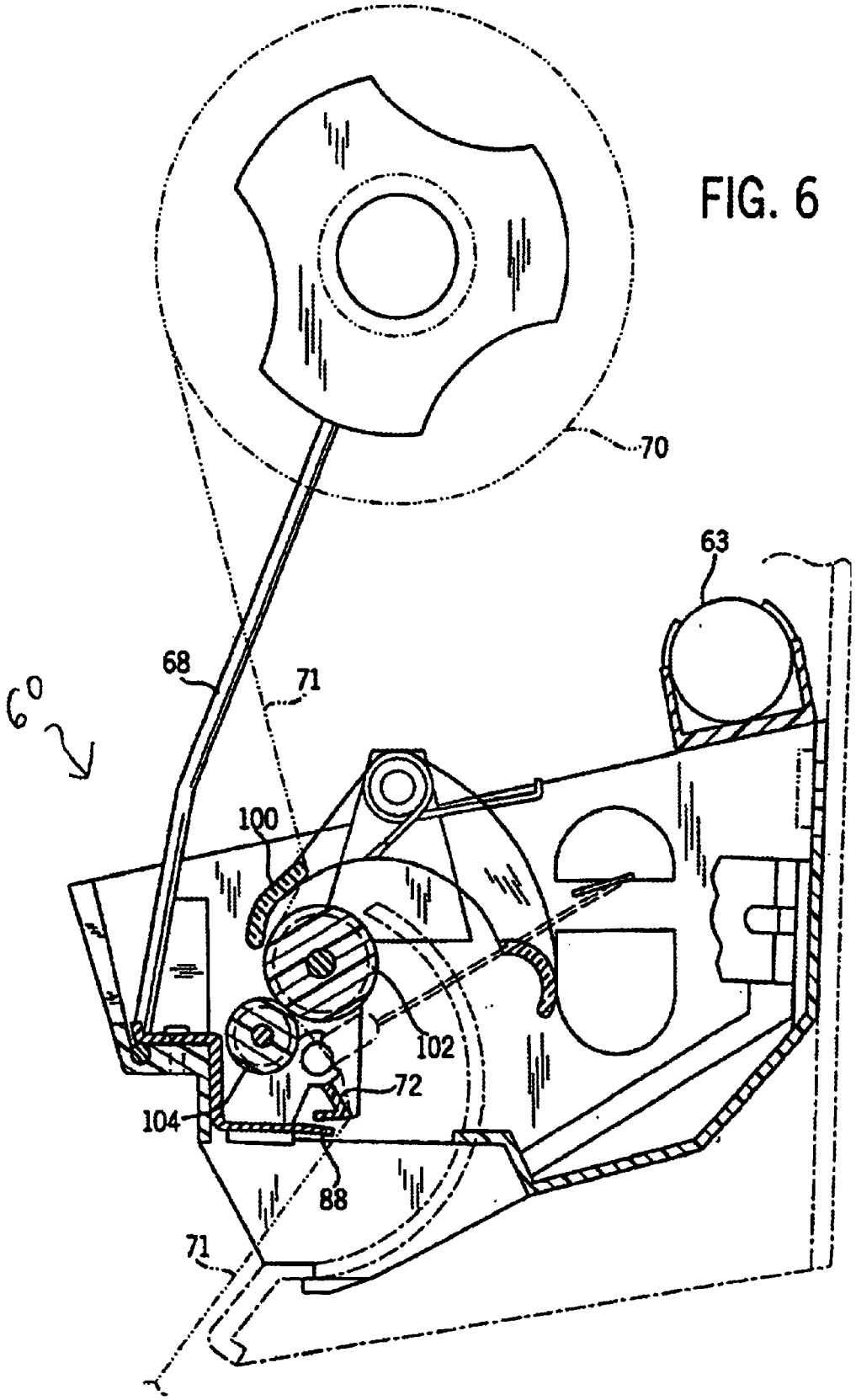
FIG. 6 is a cross-sectional view taken along line 6—6 of FIG. 4.

FIG. 4 is a perspective view of a dispenser assembly 56 that is installed in dispenser 10. The main components of the dispenser assembly 56 include the drive control assembly 32, a trigger assembly 58, and a feed drive assembly 60. A battery holder 62 for holding four D-size alkaline batteries 63, FIGS. 4 and 6, is attached to the frame 57 of the dispenser assembly 56. The battery holder 62 is electrically connected to the drive control assembly 32 by wires 64 for powering a drive motor 66 and electrical components on the printed circuit board 50 installed in drive control assembly 32. The four alkaline batteries provide a nominal six-volt (6VDC) through wires 64 to connector JP1 on the printed circuit board 50. A pair of arms 68 are pivotally mounted to and extend from the frame 57 of the dispenser assembly 56 for rotatably supporting a supply of roll paper 70, FIG. 6, in the dispenser housing 12.

Figure 5:
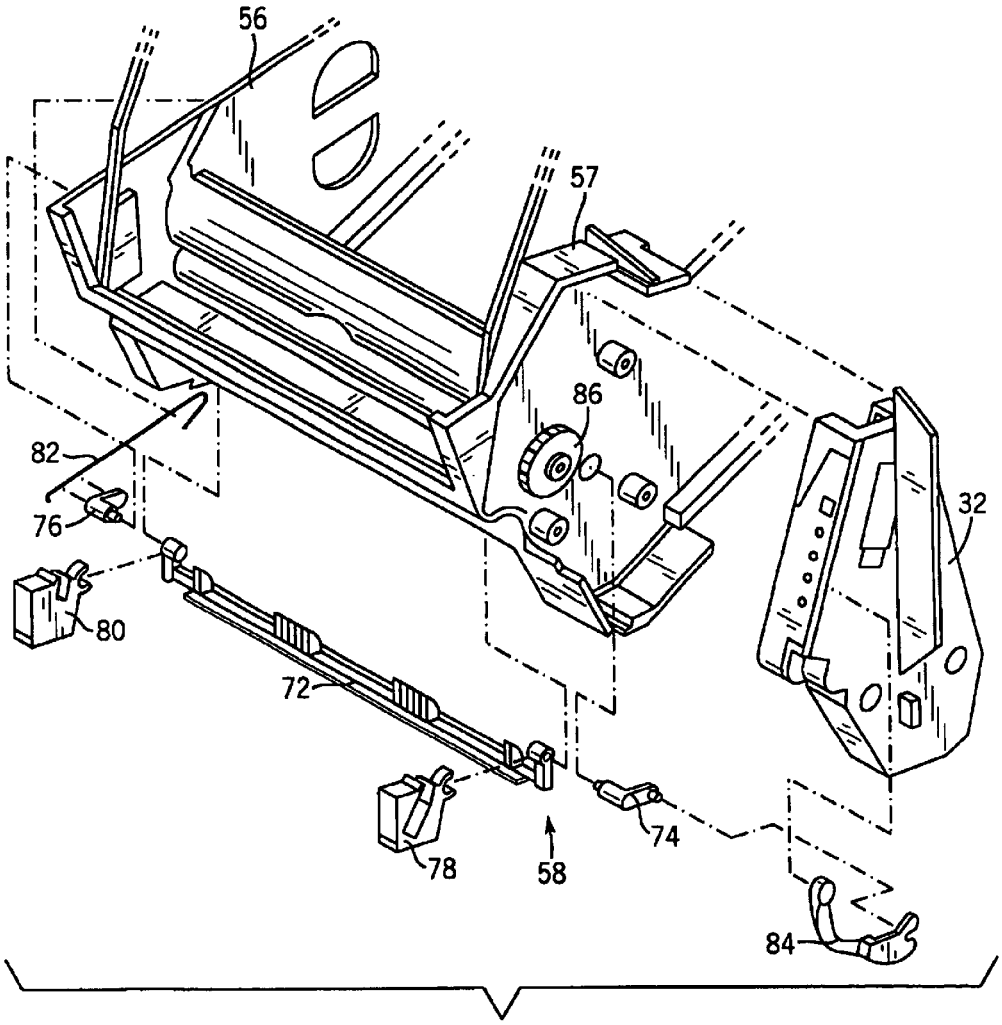
FIG. 5 is an exploded perspective view of a portion of the dispenser assembly shown in FIG. 4.

FIG. 5 is an exploded perspective view of the dispenser assembly 56 illustrating connection of the drive control assembly 32 to the side of the dispenser assembly 56, and the various components of the trigger assembly 58. The drive control assembly 32 provides the electromechanical power to the dispenser through the drive motor 66 and the electronics on the printed circuit board 50. The trigger assembly 58 provides an electrical signal to the microcontroller U2 representing the event of a length of towel being torn from the dispenser, the microcontroller then starts the drive motor after a pre-programmed delay to feed another pre-programmed length of roll paper out the discharge opening 30 of the dispenser.

Figure 7:
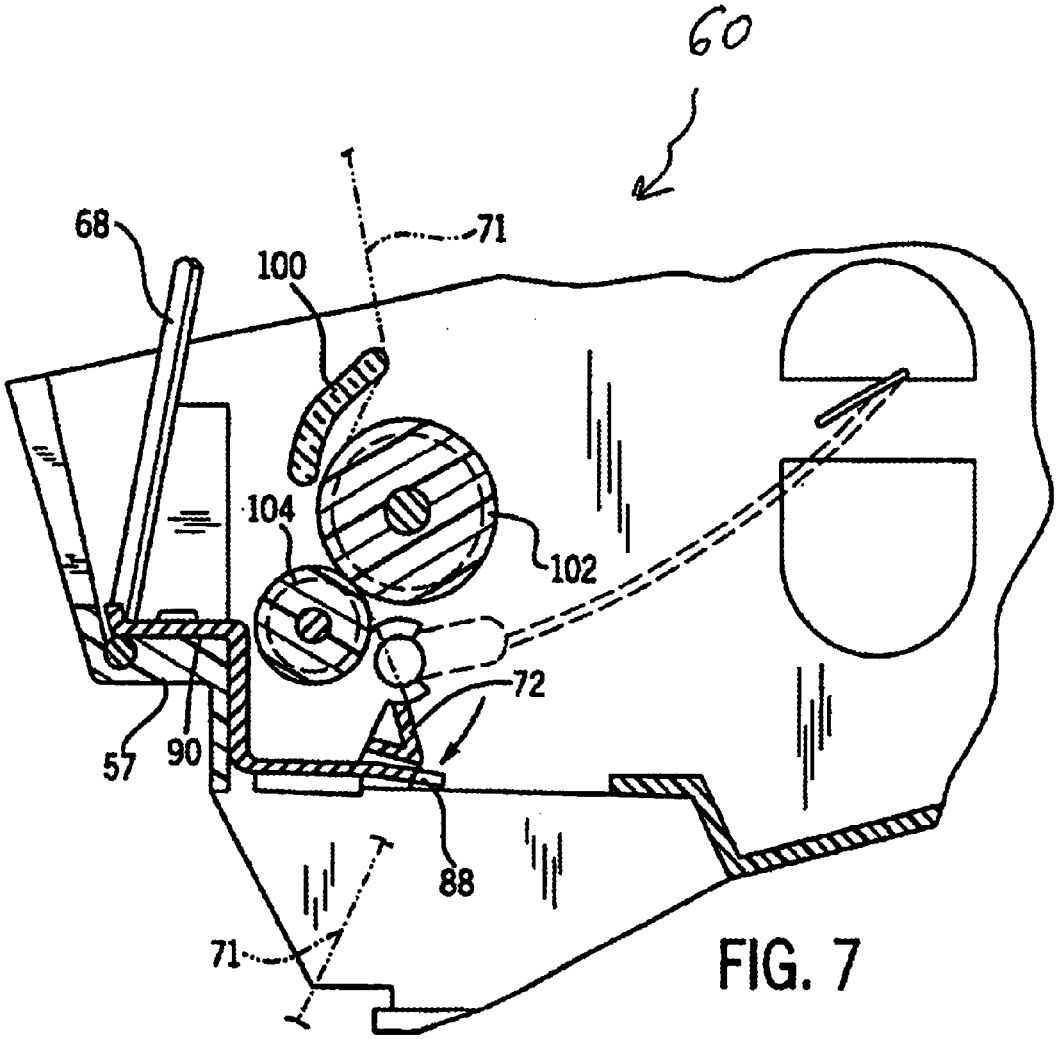
FIG. 7 is an enlarged detailed view of a portion of the dispenser assembly shown in FIG. 6.

The trigger assembly 58 includes a rotatable trigger arm 72 pivotally mounted to the frame 57 of the trigger assembly by right and left bearing blocks 78, 80 and right and left trip brackets 74, 76. The trigger arm 72 is located behind a serrated cutting bar 88, FIGS. 6 and 7, for cutting a length of paper towel from the supply roll 70. The cutting bar 88 extends from the end of a bracket 90 fastened to the frame 57 of the dispenser assembly 56 as shown in FIGS. 6 and 7. The right side of the trigger arm 72 is connected to a spring biased trigger lever 84 through the right trip bracket 74. A return spring 82 is attached to the left trip bracket 76 to provide a balanced pivoting motion on both sides of the trigger arm 72.

Figure 11:
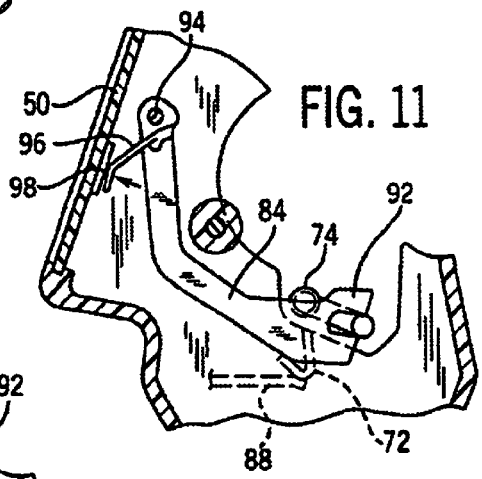
FIG. 11 is a cross-sectional view similar to FIG. 10 showing the trigger lever depressing the switch on the printed circuit board.
Figure 10:
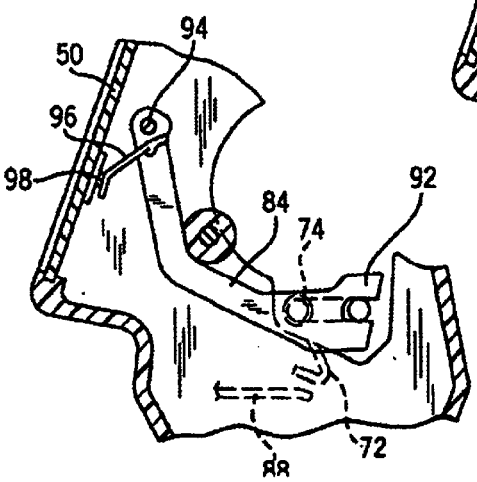
FIG. 10 is a cross-sectional view of a portion of the drive control assembly of FIG. 8 showing a trigger lever contacting a switch on a printed circuit board mounted in the drive control assembly.

FIGS. 10 and 11 show the change in motion of trigger lever 84 when the trigger arm 72 is activated by a user tearing a length of toweling from the dispenser. FIG. 11 shows the trigger arm 72 activated, while FIG. 10 shows the trigger arm 72 in its normal, unactivated position. When the trigger arm 72 is activated, the trigger lever 84 moves upwardly causing a flat spring 96 attached to one end of the lever 84 to depress a trigger switch 98 mounted on the printed circuit board 50. Once a length of toweling is torn from the cutting bar 88, the trigger arm 72 returns to its original position as shown in FIG. 10, thereby releasing pressure on the flat spring 96 contacting the switch 98 and returning the switch to an electrically open state. Actuation of the trigger switch 98 causes the microcontroller U2 to initiate the drive motor 66 to dispense another length of toweling. The trigger arm 72 activates the trigger lever 84 causing the flat spring 96 to depress the trigger switch 98 on the printed circuit board 50 to activate the drive motor 66 and the feed drive assembly 60.

FIGS. 6 and 7 illustrate the components of the feed drive assembly 60. FIG. 6 is a cross-sectional view through the dispenser assembly 56 before tearing a length of paper toweling from the supply roll 70. FIG. 7 depicts the feed drive assembly 60 after a length of paper toweling has been torn off the supply roll 70. As shown in FIGS. 6 and 7, the roll paper 71 is fed around a control bracket 100, in between the nip of a feeder roller 102 and an idler roller 104, and behind trigger arm 72 and serrated cutting bar 88.

Figure 8:
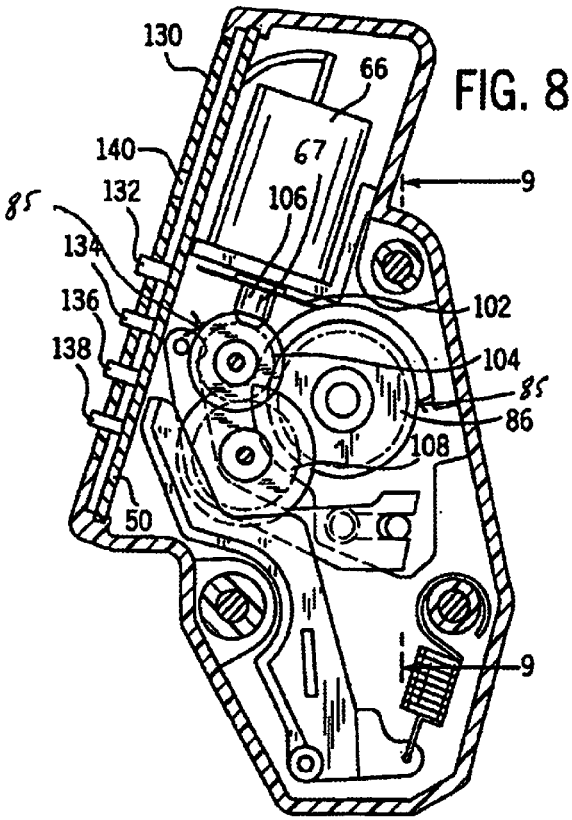
FIG. 8 is a cross-sectional view of a drive control assembly taken along line 8—8 of FIG. 4.
Figure 9:
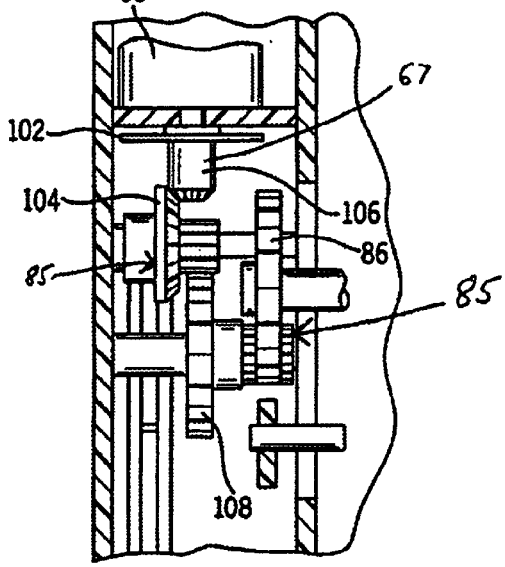
FIG. 9 is a cross-sectional view of the drive gears of the drive control assembly taken along line 9—9 of FIG. 8.

FIGS. 8 and 9 illustrate the drive motor 66 and gear assembly 85 attached to the output shaft 67 of the drive motor 66 within the drive control assembly 32. A plurality of drive reduction gears 86 are driven by the output shaft 67 of the drive motor 66. The gears 86 transfer power from the drive motor 66 to the feed drive assembly 60 for dispensing a pre-programmed length of toweling after a pre-programmed delay through the discharge opening 30 in the housing 12 each time the trigger arm 72 is activated. Operation of the drive motor 66 is controlled by microcontroller U2. The drive motor 66 is preferably a model RF-370-CA-261000 manufactured by Mabuchi Motor Company.

Figure 12:
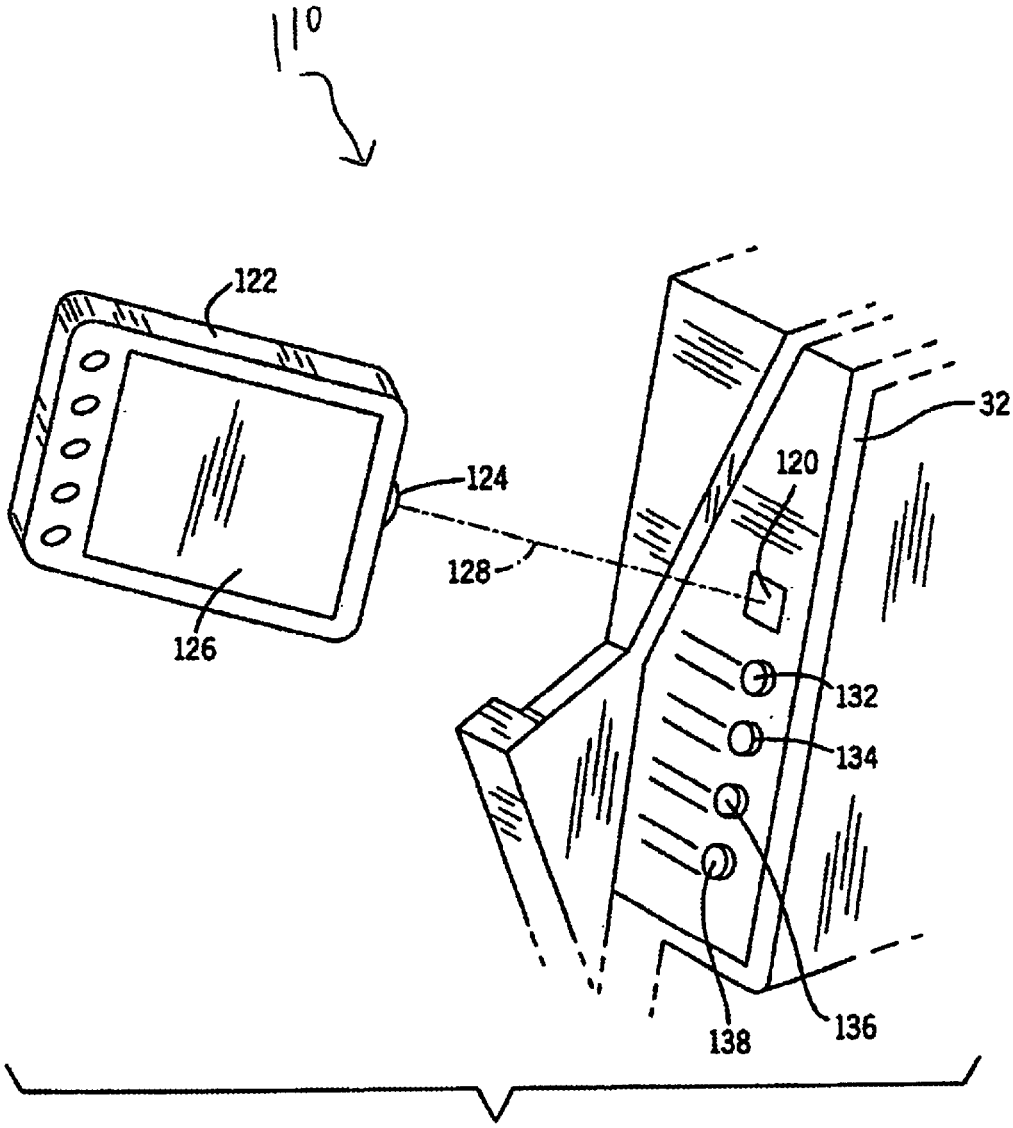
FIG. 12 is a perspective view of a data communication system used in connection with the dispenser of the present invention.

FIG. 12 illustrates the components of a data communication system 110 used in connection with the dispenser 10 of the present invention. The system 110 includes a data transmitter 120 mounted on the printed circuit board 50 of the drive control assembly 32. The data transmitter 120 is preferably a bi-colored LED, which is coupled to the microcontroller U2 to transmit visible and infrared (IR) data to a data receiver 122. The data receiver 122 preferably includes an IR detector 124 and a display screen 126 for displaying data collected from the data transmitter 120. As mentioned previously, data is transmitted through both visible light in the form of blinking green, yellow, or red colors from the LED and through IR signal transmission 128. The IR signal transmission data is transmitted in data packets, preferably in the form of the known HP-SIR communication protocol which is commonly used for IR data transfer between electronic devices. The receiver 122 is preferably a personal organizer or personal digital assistant (PDA) operating with a Palm OS operating system and an integral infrared (IR) receiver, such as those manufactured by 3Com Corporation.

Figure 13:
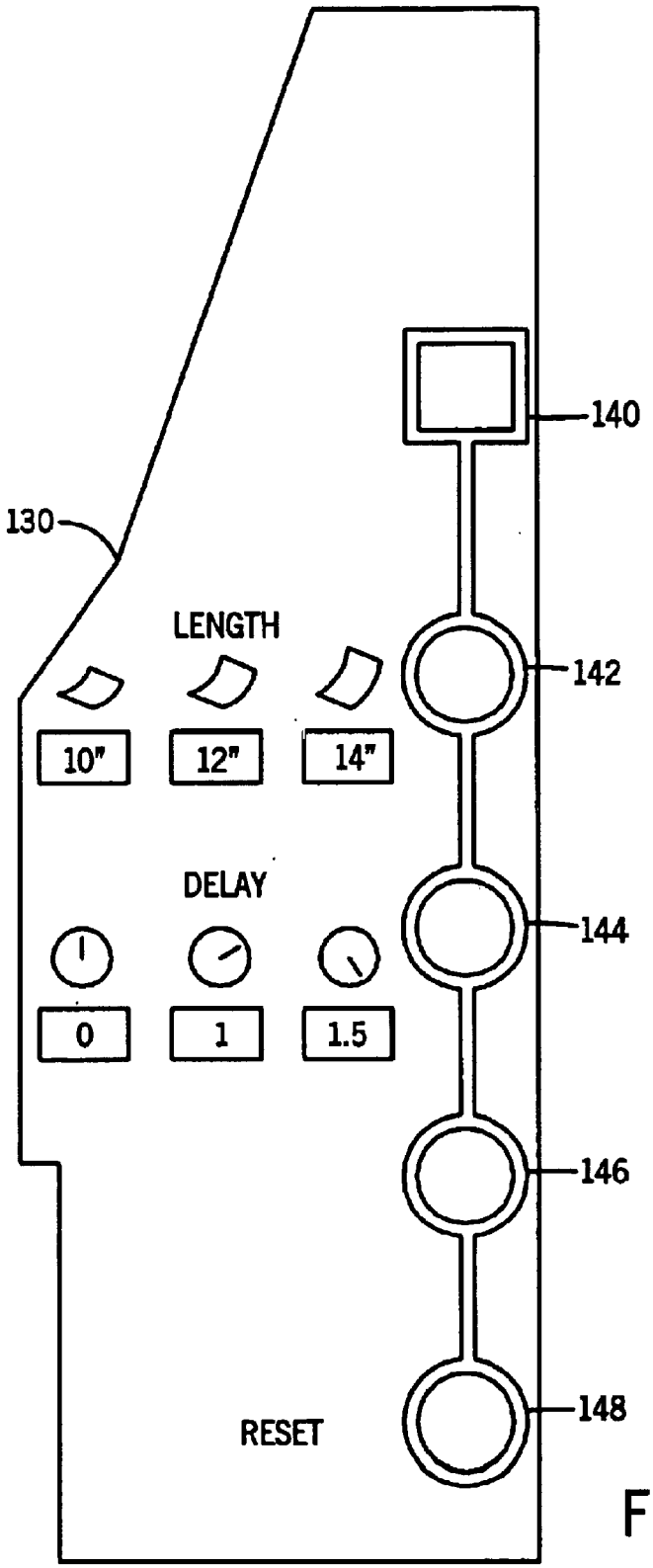
FIG. 13 is a front view of a control panel that is mounted to the drive control assembly of FIG. 8.

Referring next to FIG. 13, a control panel 130 mounted to the front of the drive control assembly 32 is shown. The control panel 130 includes a plurality of openings 140, 142, 144, 146, and 148 for the data transmitter 120 and four pushbutton membrane switches 132, 134, 136 and 138 for programming system parameters such as towel length, dispense delay, operating mode and system presets. Each of the parameters is individually selectable by pressing the appropriate switch. Pressing one of the pushbutton switches 132 or 134 will increment the value of the programmable length or delay parameters. Each parameter has default settings programmed in memory. The next pushbutton 136 toggles the system between different operating modes, such as the normal operating mode and the hygienic mode. The last pushbutton 138 is for selecting system presets.

The hygienic mode is a variation of the normal operating mode. In the hygienic mode, only a short length of paper, typically 3 or 4 inches, extends from the discharge opening. During operation, a user pulls on the short length and a full length is automatically presented to the user. The user pulling on the short length triggers the dispenser to automatically dispense the full length of paper toweling for use by the user. After the user tears the full length from the dispenser, another short length is automatically dispensed for the next user.

Figure 14A:
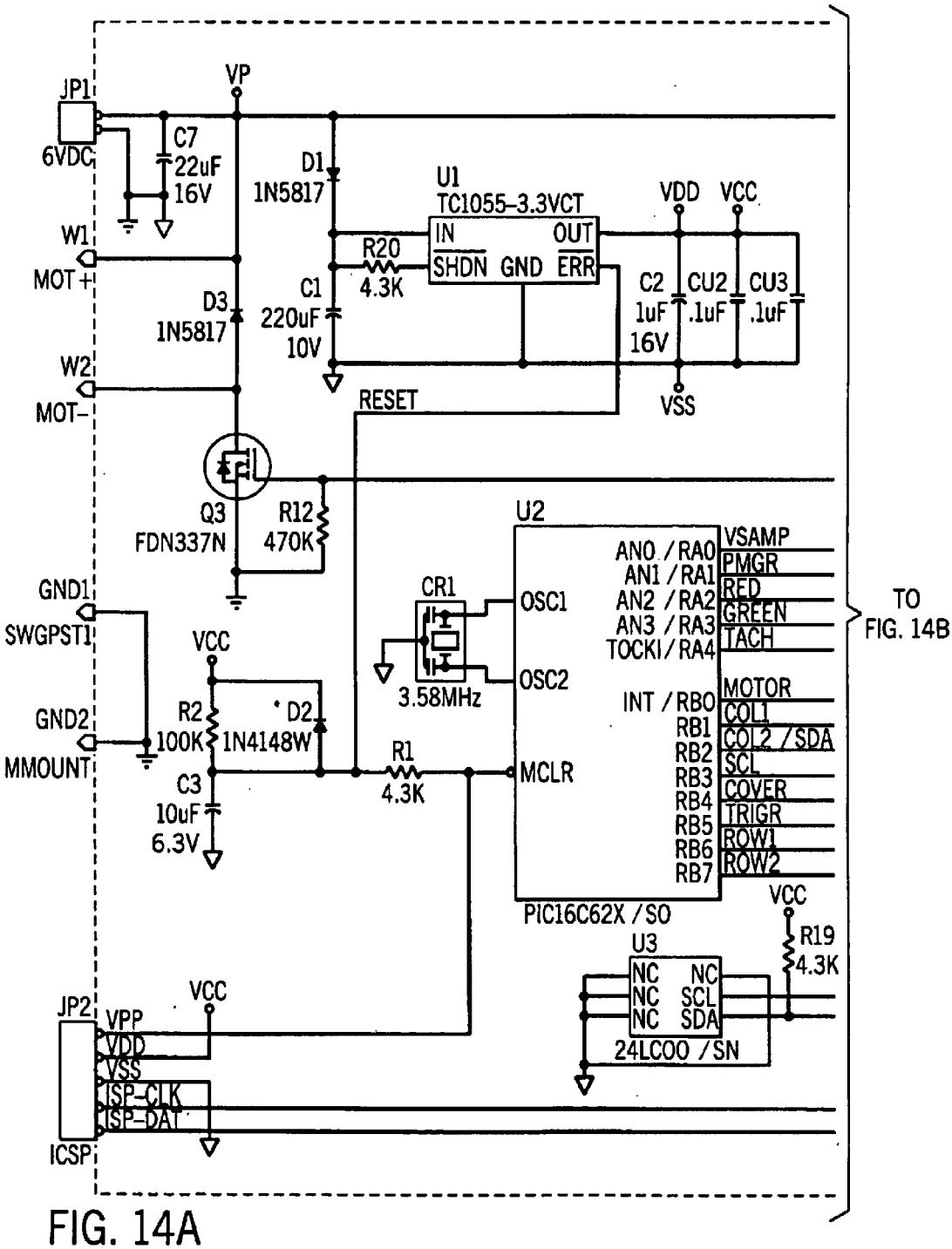
FIGS. 14A and 14B are a schematic diagram of the electrical circuitry on the printed circuit board mounted in the drive control assembly.
Figure 14B:
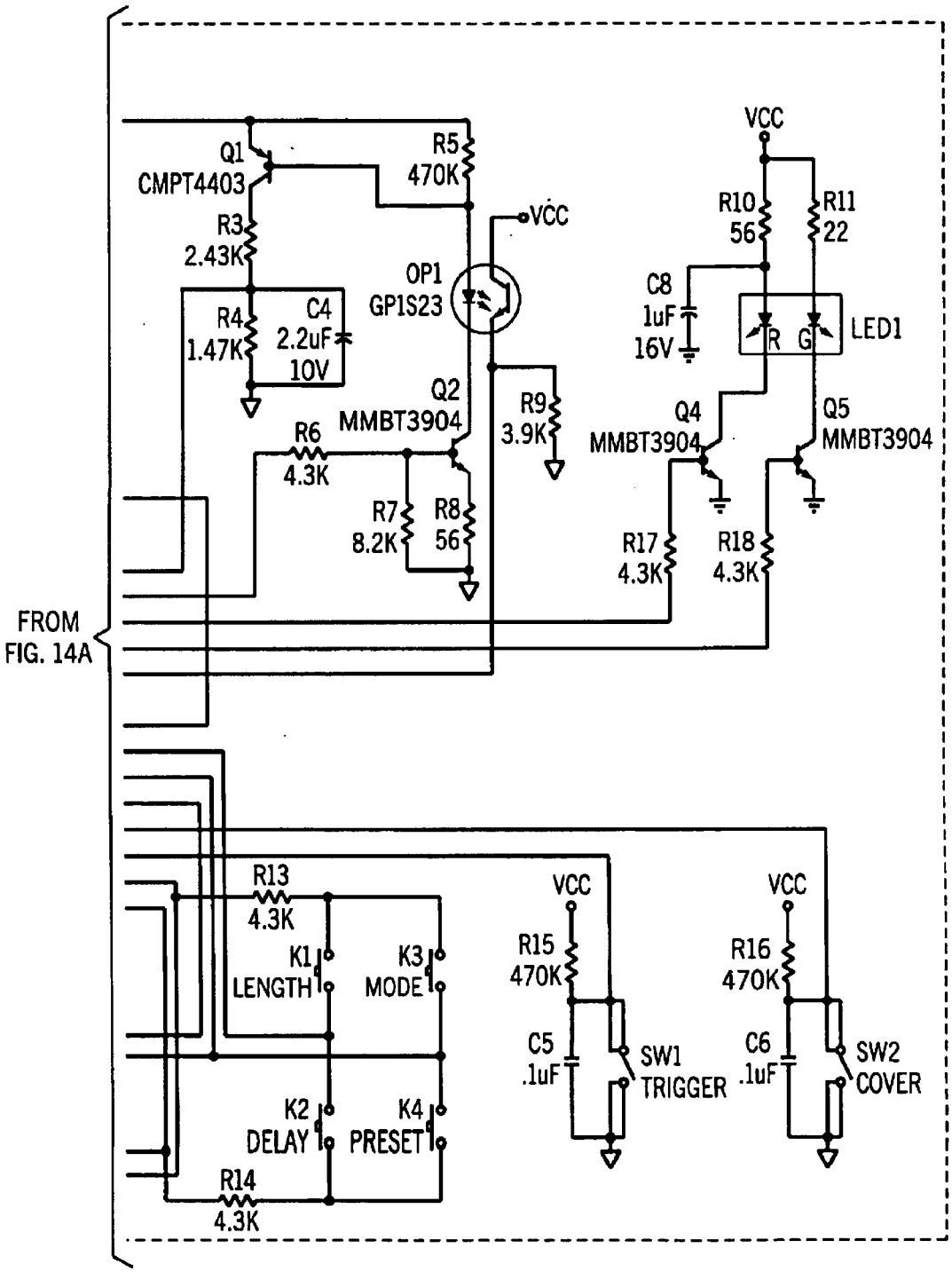

Except for the batteries and drive motor 66, all electrical components reside on the printed circuit board 50. Referring now to the schematic of electrical components on the printed circuit board 50 shown in FIGS. 14*a* and 14B, the connector JP1 provides electrical connection to a power supply through two wires 64. The power supply preferably comprises four D-size alkaline batteries which supply power to the drive motor 66 and the printed circuit board 50. The nominal voltage of each alkaline battery ranges from one and one-half volts (1.5V) for a fresh battery, to an end of service voltage of approximately nine-tenths of a volt (0.9V). This provides a power supply voltage ranging from 3.6V to 6.0V. The drive motor 66 interconnects to the printed circuit board 50 at connectors W1 and W2. W1 connects to the supply voltage and W2 connects to a digital output circuit from microcontroller U2 labeled MOTOR, which provides gating voltage for transistor Q3. A high MOTOR output turns Q3 on, allowing current to flow from the power supply through the drive motor 66 to GND. A low MOTOR output turns Q3 off, blocking motor drive current. The JP2 connector allows for serial programming of the microcontroller U2.

Moving now to the components mounted on the printed circuit board 50, the primary power supply bus VP branches to a voltage regulator circuit comprising U1 for supplying the proper voltage to the control circuitry connected to VCC. This reduced and regulated voltage improves the efficiency and extends the life of the batteries. The supply voltage VP is sampled by circuitry comprising transistor Q1 and a voltage divider formed by resistors R3, R4 and capacitor C4. With Q1 conducting, a scaled representation of the supply voltage VP is presented at the junction of resistors R3 and R4.

The main component on the printed circuit board 50 is the microcontroller U2 which includes RAM for storage of variable data, and is connected to a EEPROM U3 for storage of collected historical data and operating parameter settings. Peripheral circuitry supporting U2 include a crystal oscillator CR1 and reset circuitry comprising R2, C3 and D2. The microcontroller U2 is preferably a PIC16C62X manufactured by Microchip, Inc. Following is a summary of the microcontroller control circuits.

The analog comparator input AN0 is sourced by the voltage divider circuit of Q1, R3 and R4. When activated by control output Pmgr the voltage divider provides a scaled representation of the supply voltage VP at Vsamp.

Digital output RA1 controls a power management circuit labeled Pmgr comprising R6, R7, R8 and Q2. This circuit is used to activate the higher power circuits on an as needed basis.

The digital output circuit RA2, labeled RED, provides drive current to the red diode in an integrated bi-color LED. The digital output circuit RA3, labeled GREEN, provides drive current to the green diode in the bi-color LED. Circuit RA4 is a digital input labeled TACH. The TACH circuit provides a voltage proportional to the light transmitted between the LED and phototransistor of OP1. The apertures in the rotating encoder of drive motor 66 alternately pass or block a beam of IR light between the LED and the phototransistor in OP1, switching the voltage at RA4 from binary high to binary low.

Circuits RB1, RB2, RB3, RB6 and RB7 are digital inputs from a matrix of pushbutton switches labeled K1 LENGTH, K2 DELAY, K3 MODE and K4 PRESET.

Circuit RB5 is a digital input labeled TRIGGER from trigger switch SW1. SW1 is a normally open switch that closes when the trigger is activated. Circuit RB4 is a digital input labeled COVER from the cover switch SW2. SW2 is a normally open switch that closes when the cover interlock is activated.

FIGS. 15–24 are flow diagrams illustrating operation of the dispenser in accordance with firmware programmed in and controlled by microcontroller U2. Process control begins with the main loop flow chart of FIG. 15. Following power-up and a system reset 150, the initial state 152 of the dispenser is established. Control then enters a polling loop. Here, the primary modes of system operation are represented as power manager 154, error monitor 156, service mode 158, and dispense process 160. This sequence loops indefinitely, or until a process request is detected. The loop represents the normal idling state of the system as it awaits some kind of outside interaction or interrupt.

Figure 15:
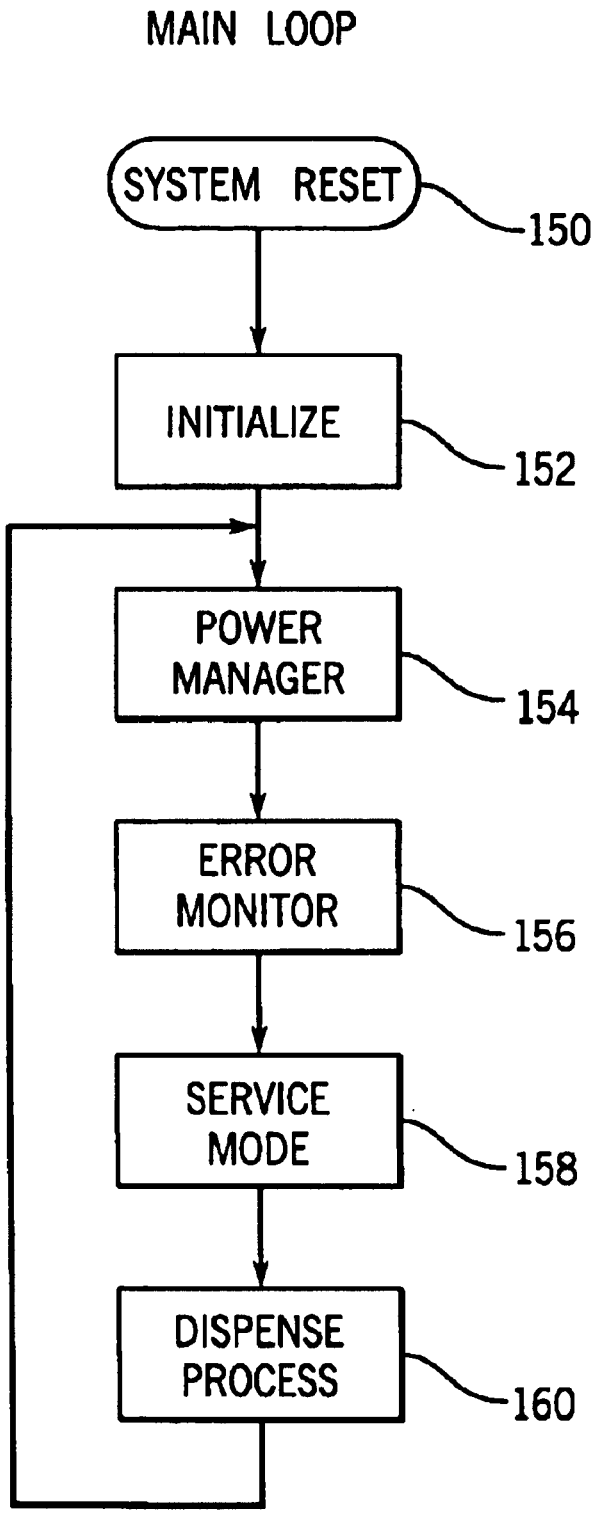
FIGS. 15–24 are flow diagrams illustrating operation of the dispenser in accordance with the present invention.
Figure 16:
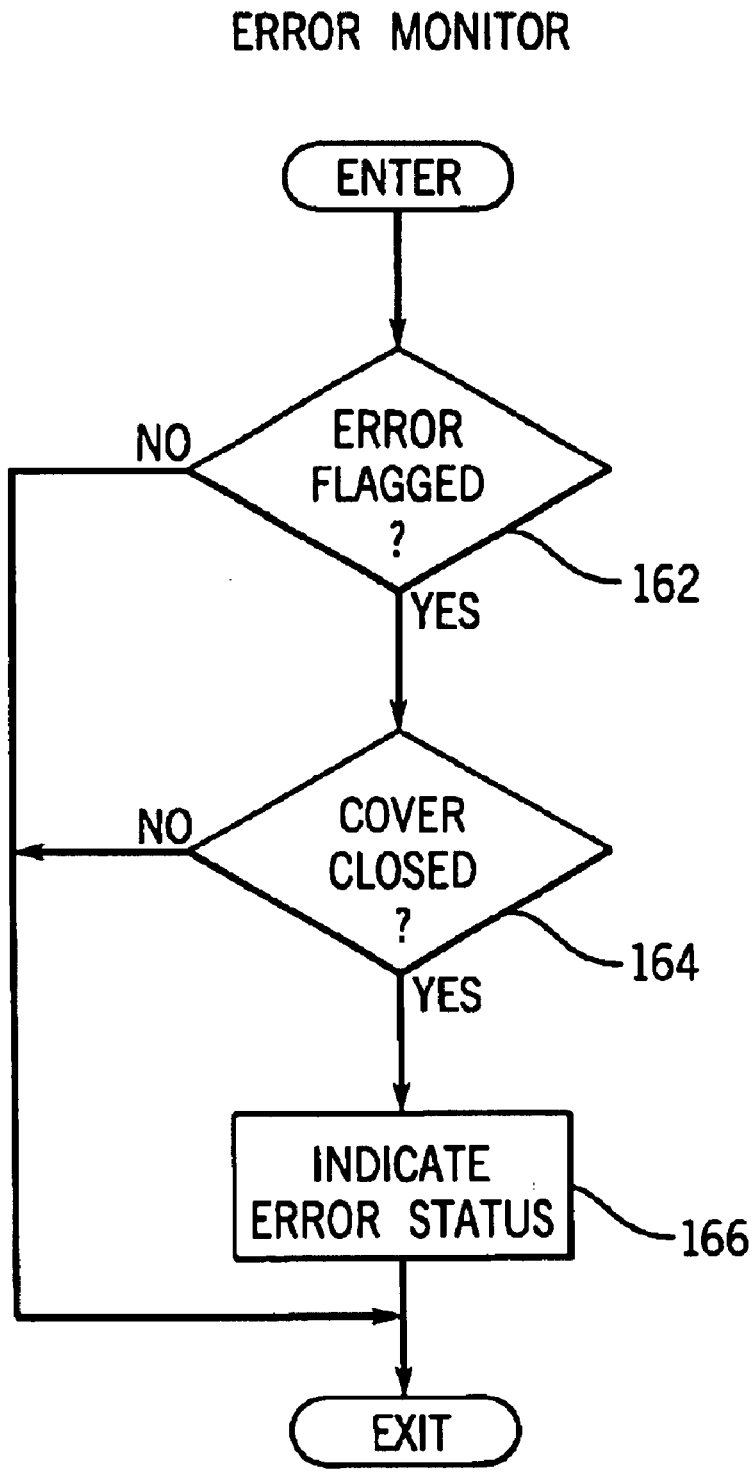

The power manager 154 extends battery life by putting the system into a sleep mode after a certain amount of time. The system wakes up from the sleep mode when it receives an interrupt. The next process in FIG. 15 is the error monitor 156 of FIG. 16.

Figure 17:
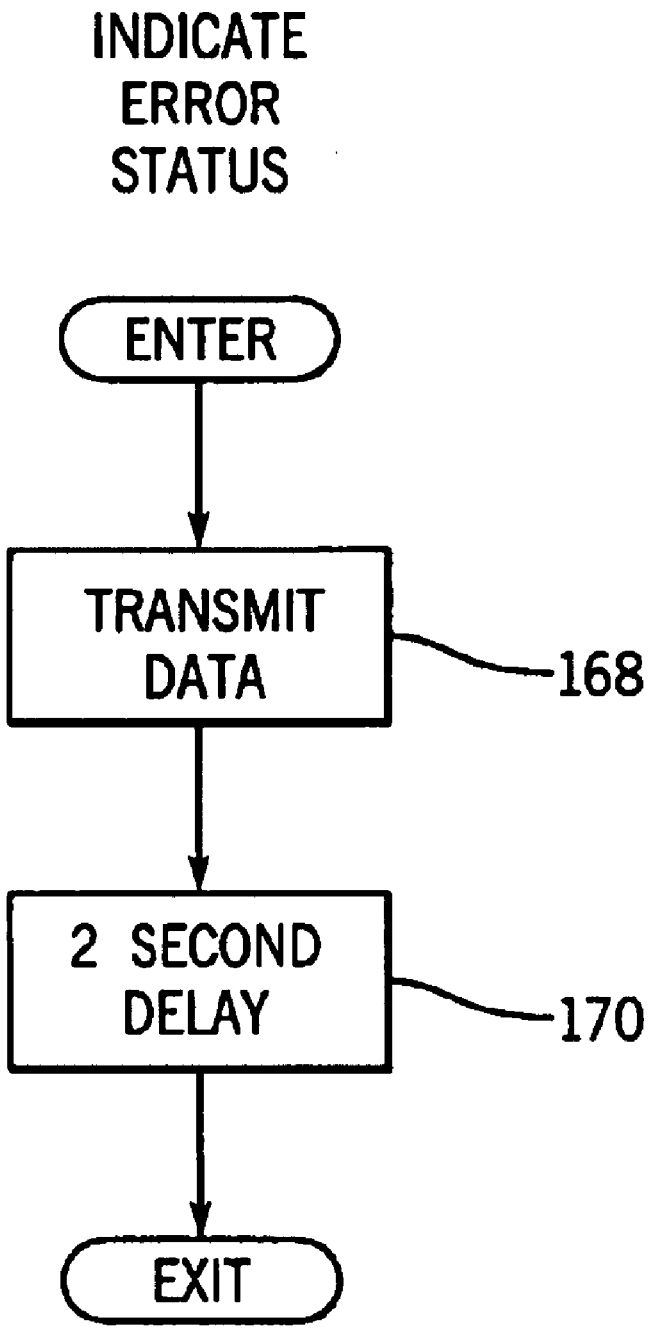

In the error monitor process, the system is continuously monitored for a system error 162. If no error is detected, then the system returns to the main loop of FIG. 15. However, if an error is detected and the cover is closed 164, the error status is indicated 166 as shown in FIG. 17 by the LED transmitting error status data 168 and initiating a two second delay 170. The transmitted data may then be transmitted visually and through IR data transmission to a receiving device while the dispenser is in the service mode.

The next process in the main loop is the service mode 158. The dispenser cover must be open for the dispenser to be in service mode. The first process in service mode is the status indicator process 172 of FIG. 19. In the status indicator process 172, the battery voltage is monitored. If the battery voltage is less than 10% of full voltage 188, then the Red LED blinks on and off and transmits data that the batteries should be replaced 192. If the battery voltage is less than 20% of full voltage 190, then the Yellow LED blinks on and off and transmits data that the batteries are low and should be replaced soon 194. If the battery voltage is greater than 20% of fill voltage 190, then the Green LED blinks on and off and transmits data that the batteries are good and do not need to be replaced 196.

Figure 18:
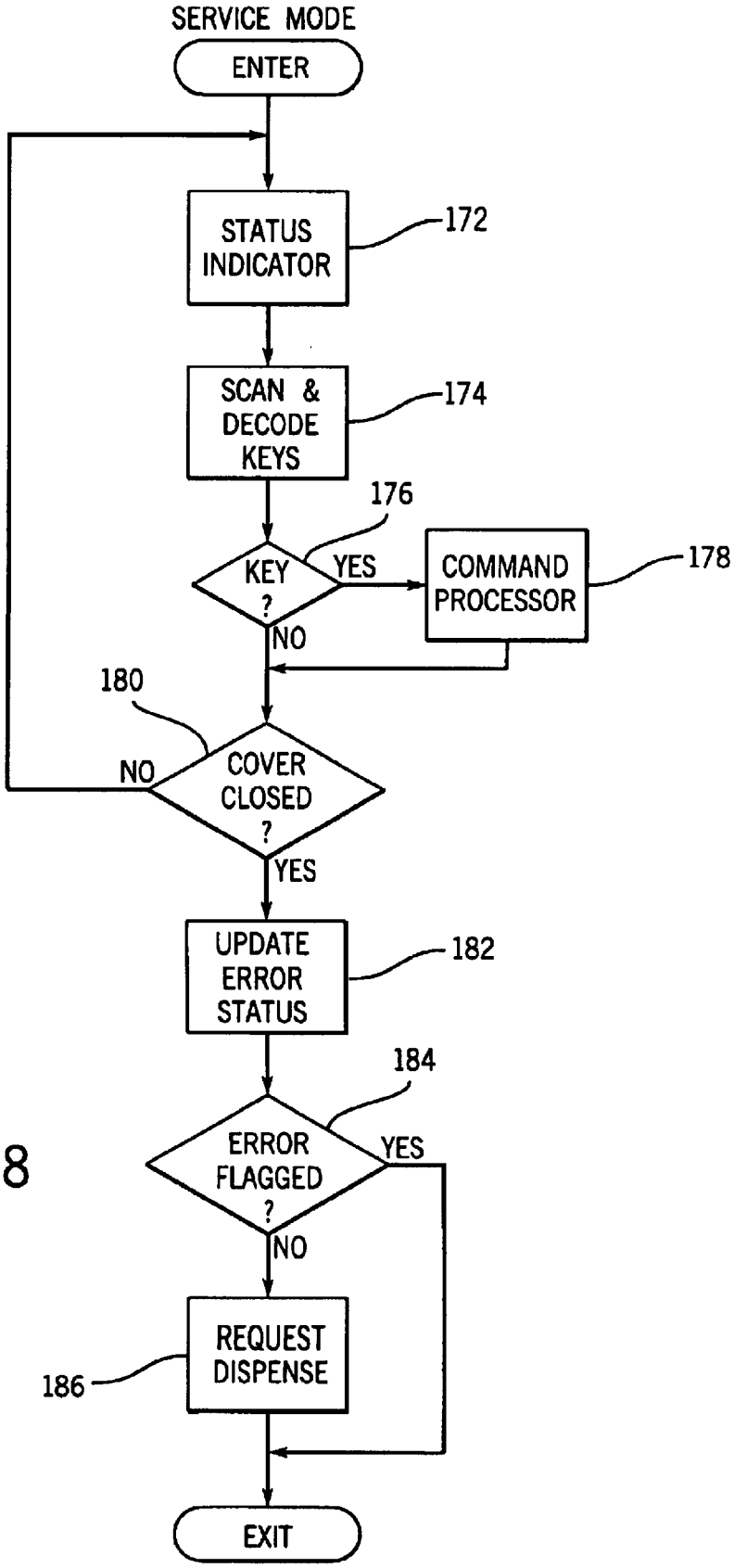
Figure 19:
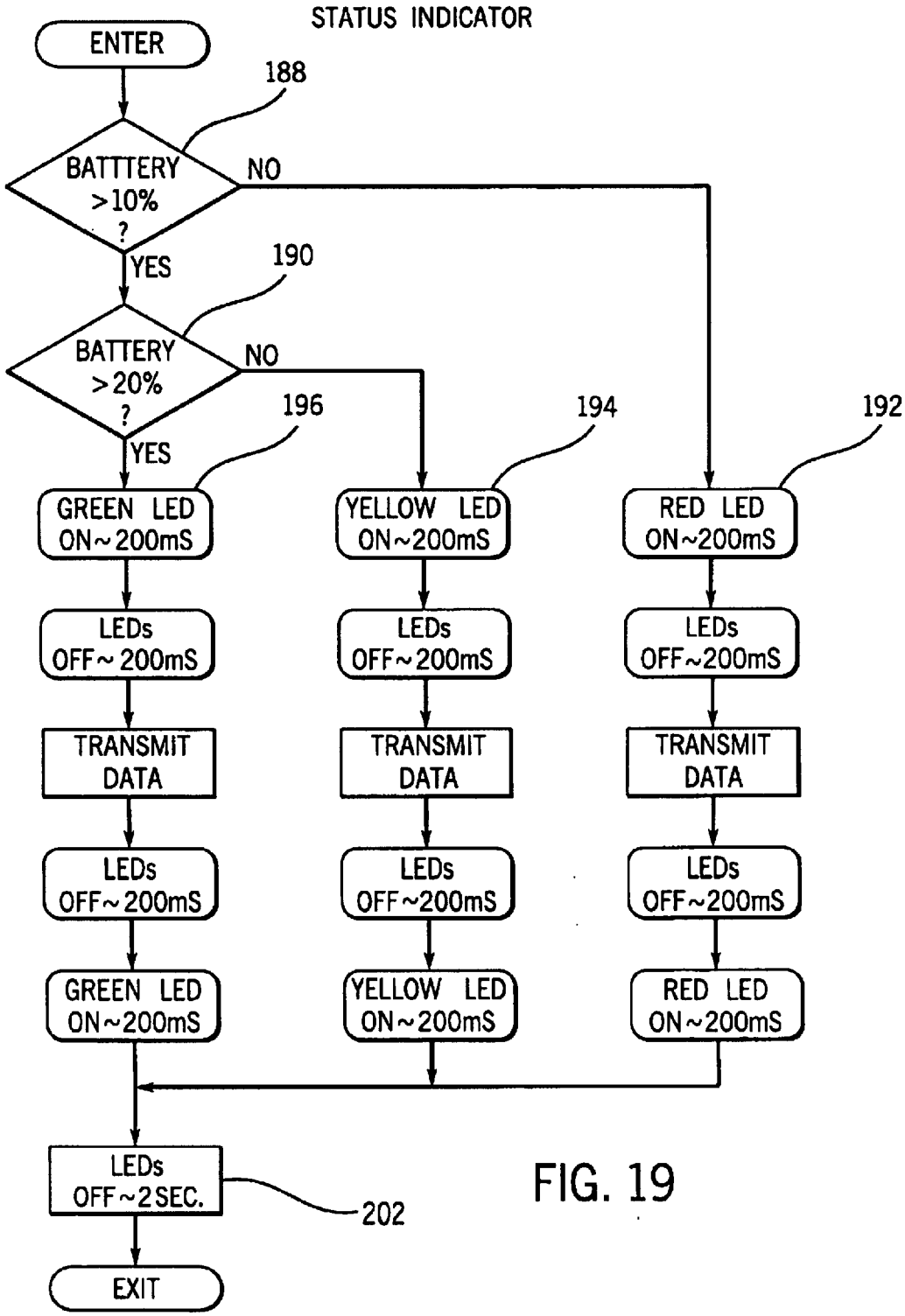
Figure 20:
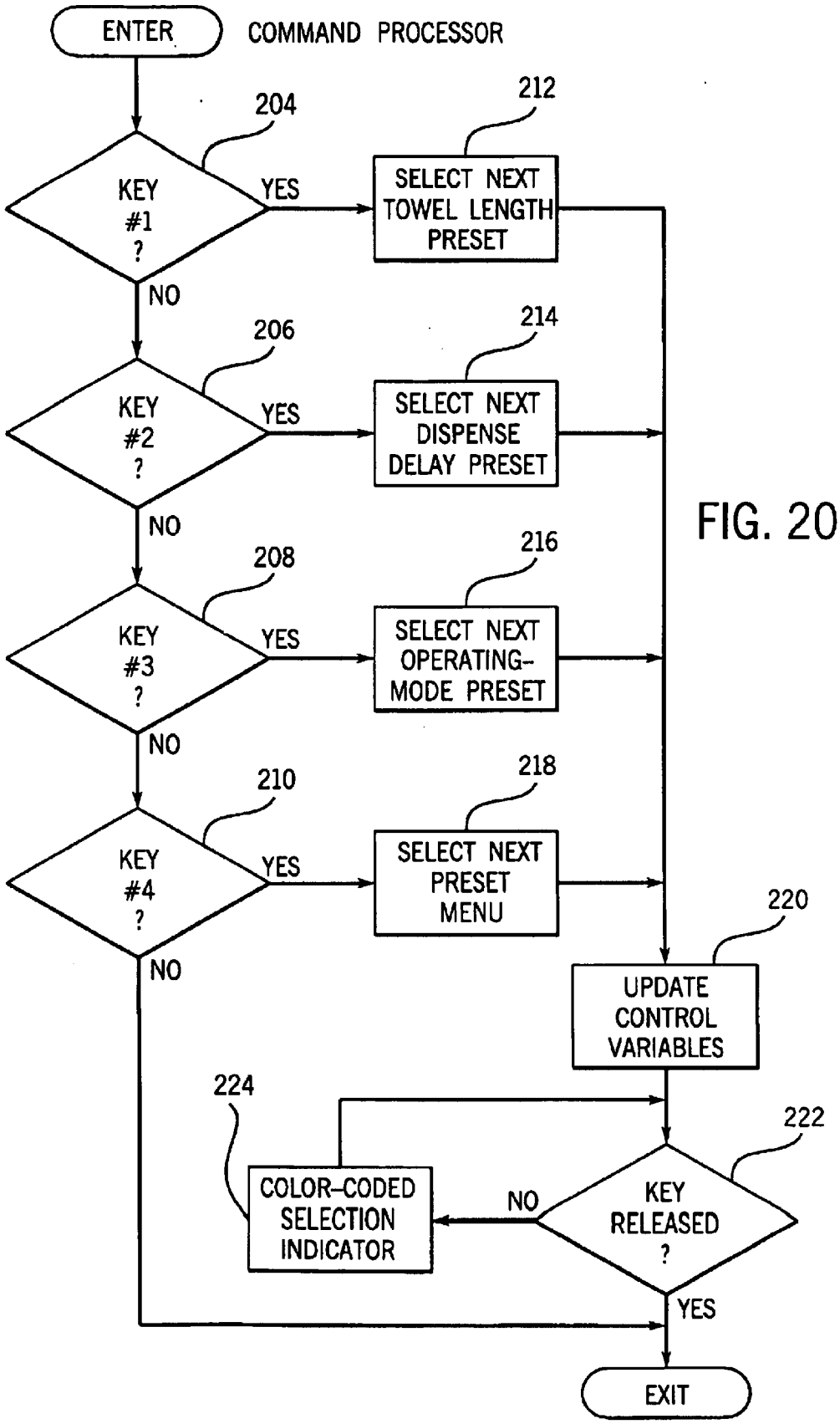

Returning to the service mode 158 of FIG. 18, the next step in the process is to scan and decode the pushbutton keys 174 on the control panel 130 to determine if any have been depressed 176. If any of the keys have been depressed 176, then the process shifts to the command processor 178 in FIG. 20. If the first key corresponding to programmable towel length has been pressed 204, then the next towel length preset is selected 212 and the control variables are updated in memory 220. If the key is not released 222, review the color-coded selection indicator 224. If the second key corresponding to programmable dispense delay has been pressed 206, then the next dispense delay preset is selected 214 and the control variables are updated in memory 220. If the key is not released 222, review the color-coded selection indicator 224. If the third key corresponding to operating mode has been pressed 208, then the next operating mode preset is selected 216 and the control variables are updated in memory 220. If the key is not released 222, review the color-coded selection indicator 224. If the fourth key corresponding to system preset has been pressed 210, then the next preset menu is selected 218 and the control variables are updated in memory 220. If the key is not released 222, review the color-coded selection indicator 224.

Returning again to the service mode 158 of FIG. 18, the system checks to see if the cover is closed 180 by checking the cover interlock. If the cover is closed, then the error status is updated 182 as shown in FIG. 21.

Figure 21:
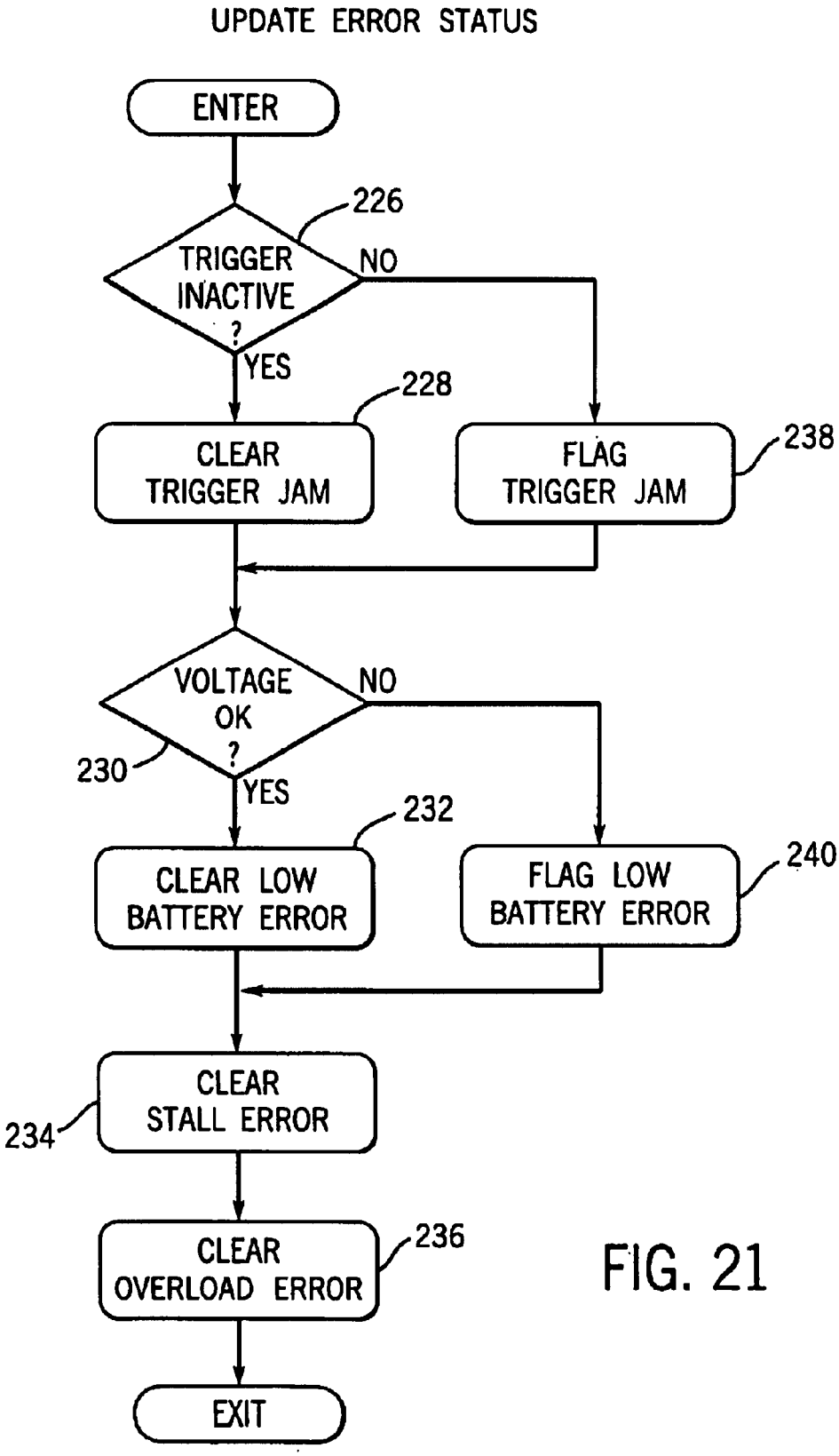
Figure 22:
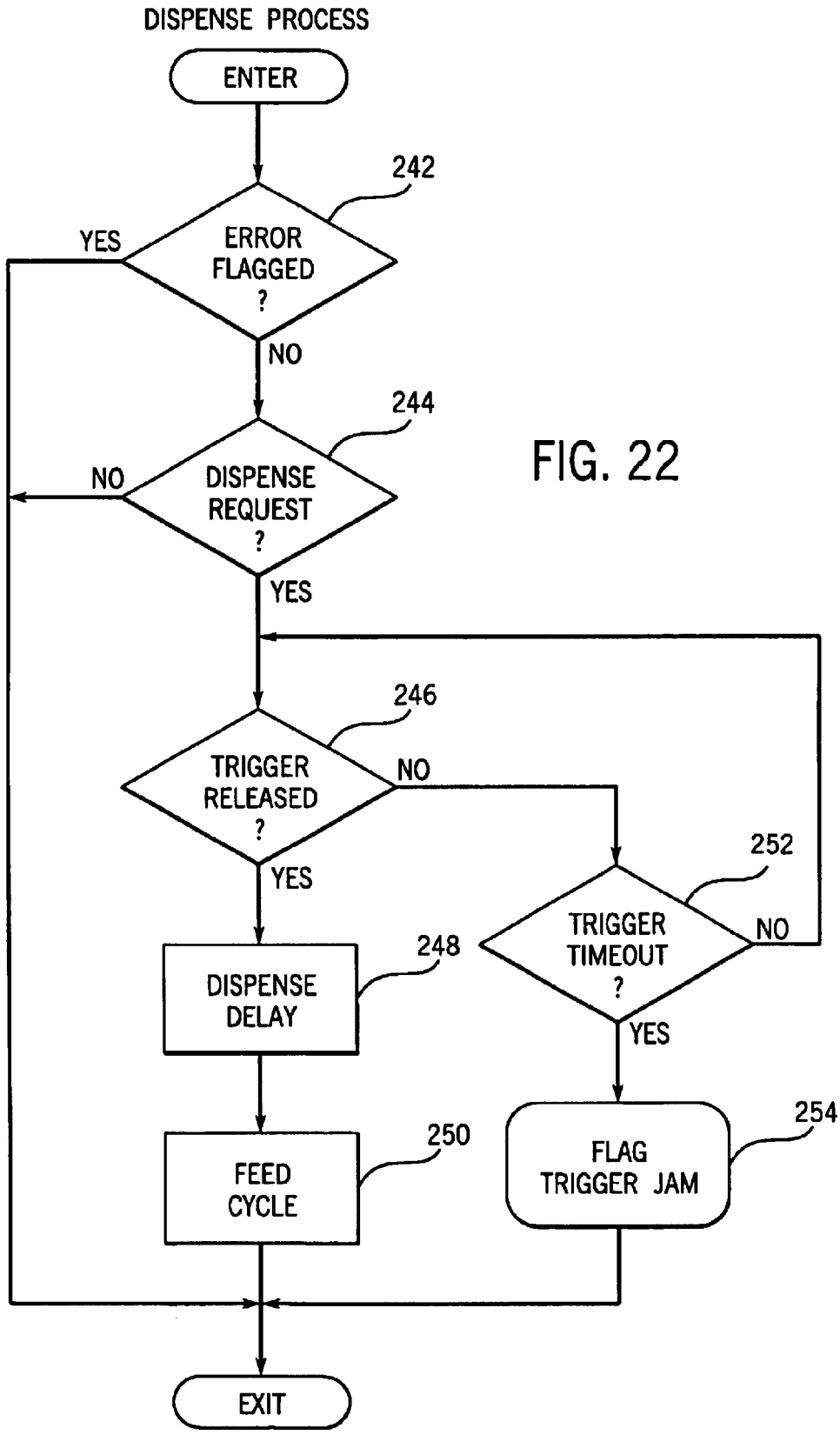

In the update error status process 182 of FIG. 21, the trigger is checked to determine if it is inactive 226. If the trigger is inactive, then a trigger jam error is cleared 228. However, if the trigger is not inactive, then a trigger jam error is flagged 238. The next step involves checking the battery voltage 230. If the voltage is good, then a low battery error is cleared 232. However, if the voltage is not good, then a low battery error is flagged 240. The system may also clear a stall error 234 or an overload error 236.

Returning again to the service mode process 158 of FIG. 18, the system makes a final check to determine if an error was flagged 184. If not, a dispense is requested 186. The next process is the dispense process of FIG. 22.

In the dispense process, the system checks for a flagged error 242 and a dispense request 244. If a dispense has been requested by an activated trigger, the system checks to determine if the trigger has been released 246. If not, the system checks for a trigger timeout 25. If there has been a trigger timeout, then a trigger jam error is flagged 254. If the trigger was released, then the system initiates a dispense delay 248 and a feed cycle 250.

Figure 23:
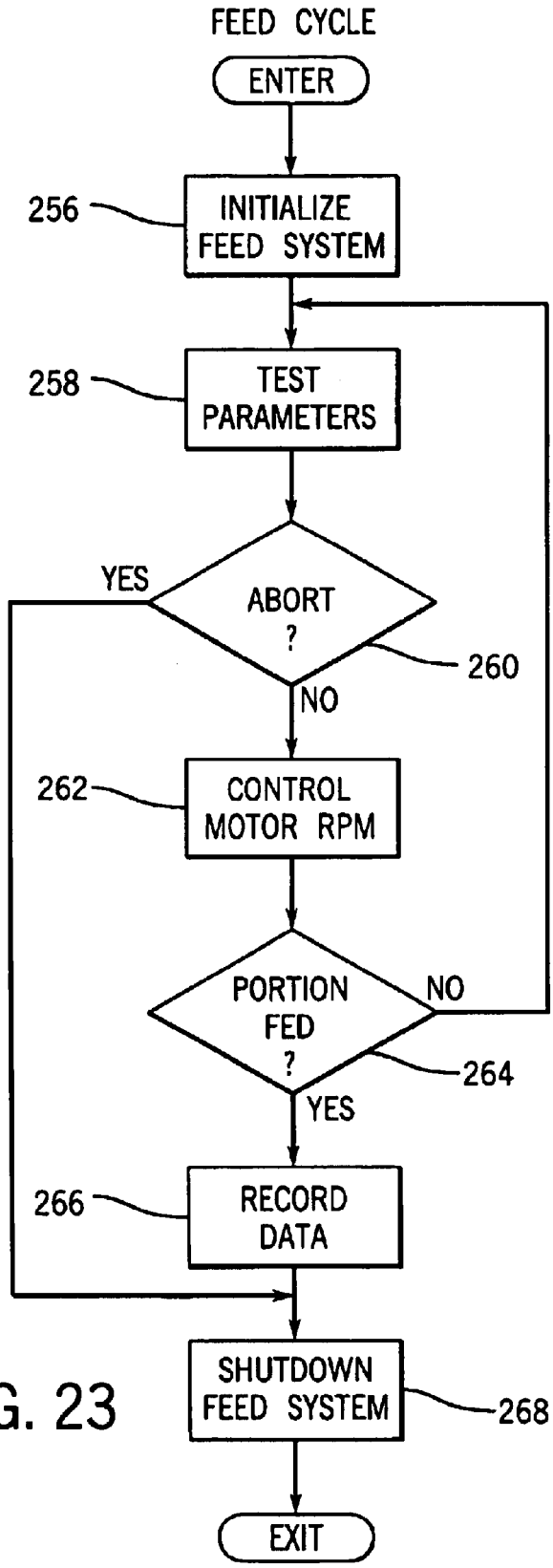
Figure 24:
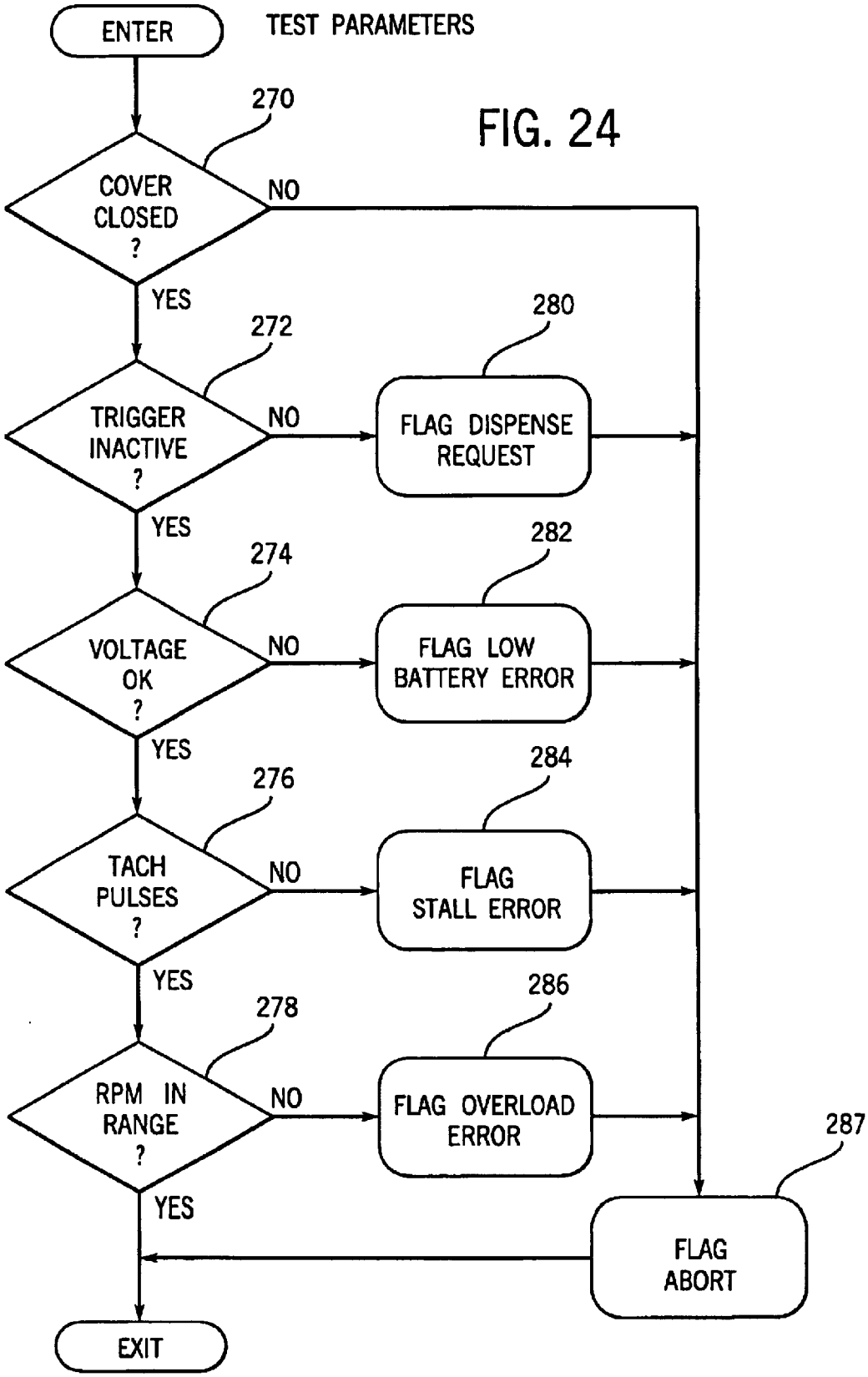

The feed cycle shown in FIG. 23 is started by initializing the feed system 256. Next, test parameters are activated 258. The test parameters process 258 is shown in FIG. 24. In the test parameters process 258, the system checks to see if the cover is closed 270. If the cover is open, the process is aborted 287 and the program returns to the main loop of FIG. 15. If the cover is closed, then the system checks for an inactive trigger 272. If the trigger is not inactive, a dispense request is flagged 280. If the trigger is inactive, then the system checks battery voltage 274. If the battery voltage is low, then a low battery error is flagged 282. If the voltage is good, the system checks for tach pulses 276 from the drive motor. If there are no tach pulses, then a stall error is flagged 284. If the tach pulses are present, then the system checks for the correct RPM of the drive motor 278. If the RPM is not in an acceptable range, then an overload error is flagged 286. The program then jumps back to the feed cycle of FIG. 23. In the next step of the feed cycle after the test parameters process 258, the system checks to if there was an abort flagged 260. If an abort was flagged, the feed system is shutdown 268 and the program returns to the main loop in FIG. 15. If an abort was not flagged, then the RPM 262 and angular displacement 264 of the drive motor are monitored by the feed system to determine feeding speed and towel length, respectively. The data is recorded in memory 266. The feed system is shutdown 268 and the program jumps back to the main loop. This program loop continues indefinitely as long as the dispenser is powered.

While the invention has been described with reference to preferred embodiments, those skilled in the art will appreciate that certain substitutions, alterations, and admissions may be made without departing from the spirit of the invention. Accordingly, the foregoing description is meant to be exemplary only and should not limit the scope of the invention set forth in the following claims.

We claim:

1. An electronically controlled dispenser comprising:

a housing having a back panel adapted to be fastened to a wall, first and second side panels, a front cover pivotally connected to the housing, and a discharge opening for feeding a length of paper out of the dispenser;

a dispenser assembly having a frame for rotatably supporting a supply roll of paper within the housing;

a feed drive assembly, having a drive motor and a plurality of rollers for advancing paper from the supply roll though the discharge opening;, a movable trigger assembly for automatically activating the feed drive assembly in response to a user pulling or tensioning a previously dispensed length of roll paper to dispense another length of paper from the supply roll though the discharge opening; and a fixed cutting bar, not connected to said trigger assembly, for tearing paper dispensed from said the dispenser.

2. The dispenser of claim 1 wherein the length of paper dispensed is programmable.

3. The dispenser of claim 1 wherein the dispenser is battery powered.

4. The dispenser of claim 1 wherein the front cover is movable between an open position and a closed position on the housing.

5. The dispenser of claim 1 further comprising a cover interlock assembly to monitor the front cover.

6. The dispenser of claim 5 wherein the cover interlock assembly includes a switch that when the front cover is opened or closed, the switch sends a signal to the microcontroller to change operation of the dispenser from a normal operating mode to a service mode.

7. The dispenser of claim 1 wherein the dispenser is in a normal operating mode when the front cover is in a closed position.

8. The dispenser of claim 1 wherein the dispenser is in a service mode when the front cover is in an open position.

9. The dispenser of claim 1 wherein the drive motor includes an encoder for dispensing a predetermined length of roll paper after a predetermined dispense delay.

10. The dispenser of claim 9 wherein the dispense delay after the trigger assembly has been activated is programmable.

11. The dispenser of claim 1 wherein the trigger assembly includes a rotatable trigger arm pivotally mounted to the dispenser assembly and located behind said fixed cutting bar.

12. The dispenser of claim 11 wherein roll paper fed through the feed drive assembly contacts and rotates the trigger arm when a user pulls on an exposed length of roll paper extending from the dispenser.

13. The dispenser of claim 12 wherein the trigger arm activates a trigger switch which sends a signal to a microcontroller to initiate the feed drive assembly to dispense a length of roll paper for a user.

14. The dispenser of claim 1 further comprising a drive control assembly interacting with the dispenser assembly having a microcontroller for controlling operation of the feed drive assembly through an embedded program to automatically dispense a predetermined length of paper after the trigger assembly has been activated.

15. The dispenser of claim 14 further comprising a data transmitter coupled to the drive control assembly for transmitting visual and digital data from the dispenser.

16. The dispenser of claim 15 further comprising a control panel mounted to the drive control assembly including a plurality of openings for the data transmitter and a plurality of switches for programming length of roll paper dispensed, dispense delay, operating mode and system presets.

17. The dispenser of claim 15 wherein the data transmitter transmits visual data when the front cover is in an open position or a closed position.

18. The dispenser of claim 15 wherein the data transmitter transmits digital data when the front cover is in an open position and the dispenser is operating in a service mode.

19. The dispenser of claim 15 wherein the data transmitter is a bi-colored LED for transmitting visual and IR data.

20. The dispenser of claim 19 wherein the IR data is transmitted in data packets using a HP-SIR communication protocol.

21. The dispenser of claim 15 further comprising a data communication system incorporated within the drive control assembly including a data receiver located remotely from the dispenser for receiving data from the data transmitter.

22. The dispenser of claim 21 wherein the data receiver is a personal organizer or PDA with an integral IR receiver.

23. An electronically controlled dispenser comprising:

a housing having a back panel adapted to be fastened to a wall, first and second side panels, a front cover pivotally connected to the housing, and a discharge opening for feeding a length of roll paper out of the dispenser;

a dispenser assembly having a frame for rotatably supporting a supply roll of roll paper within the housing;

a feed drive assembly, having a drive motor and a plurality of rollers for advancing paper from the supply roll though the discharge opening;

a movable trigger assembly for automatically activating the feed drive assembly in response to an operator pulling or tensioning a previously dispensed length of roll paper to dispense another length of roll paper from the supply roll though the discharge opening;

a fixed cutting bar, not connected to said trigger assembly, for tearing paper dispensed from said the dispenser; and a drive control assembly having a microcontroller for controlling operation of the feed drive assembly through an embedded program to automatically dispense a the predetermined length of roll paper after the trigger assembly has been activated.

24. The dispenser of claim 23 further comprising a data transmitter coupled to the drive control assembly for transmitting data collected by the microcontroller to a data receiver located remotely from the dispenser.

25. The dispenser of claim 23 wherein the length of roll paper dispensed is programmable.

26. The dispenser of claim 23 wherein the dispense delay after the trigger assembly has been activated is programmable.

27. The dispenser of claim 23 wherein the dispenser is battery powered.

28. A rolled material dispenser comprising:

a housing with a discharge opening through which rolled material is dispensed;

a support assembly for rotatably supporting a supply of rolled material to be dispensed;

a drive assembly having a drive motor for advancing the rolled material from the supply roll through the discharge opening; and a trigger assembly, having a trigger arm rotatably actuated by a user tensioning a previously dispensed length of roller material, wherein the actuation of the trigger arm activates the drive motor to dispense a predetermined length of rolled material through the discharge opening; and a fixed cutting bar, that is not attached to and is distinct from said trigger assembly for selectively tearing rolled material dispensed through the discharge opening.

29. An electronically controlled roll towel dispenser with a data communication system comprising:

a housing having a back panel adapted to be fastened to a wall, first and second side panels, a front cover pivotally connected to the housing, and a discharge opening for feeding a length of paper toweling out of the dispenser;

a dispenser assembly having a frame for rotatably supporting a supply roll of paper toweling within the housing;

a feed drive assembly, having a drive motor and a plurality of rollers for advancing paper toweling from the supply roll though the discharge opening;

a movable trigger assembly for activating the feed drive assembly to dispense a predetermined length paper toweling from the supply roll though the discharge opening;

a fixed cutting bar, not connected to said trigger assembly, for tearing paper dispensed from said the dispenser;

a drive control assembly having a microcontroller for controlling operation of the feed drive assembly through an embedded program to automatically dispense a predetermined length of paper toweling after the trigger assembly has been activated;

a data transmitter coupled to the drive control assembly for transmitting visual and digital data from the dispenser; and, a data receiver located remotely from the dispenser for receiving data from the data transmitter.

30. The dispenser of claim 29 wherein the trigger arm is activated by a user tensioningan exposed length of paper toweling across the trigger armof the dispenser.

31. The dispenser of claim 30 wherein the activated trigger arm sends a signal to the microcontroller to activate the drive motor to automatically dispense another length of paper toweling to user.

32. The dispenser of claim 29 wherein the roll paper fed through the feed drive assembly contacts the trigger arm and the cutting bar.

* * * * *